US012740675B2

(12) United States Patent
Lortie et al.

(10) Patent No.: US 12,740,675 B2
(45) Date of Patent: Sep. 22, 2026

(54) ROLLED PRODUCT DISPENSER AND BUSHING FOR A ROLLED PRODUCT

(71) Applicant: CASCADES CANADA ULC, Kingsey Falls (CA)

(72) Inventors: Maude Lortie, Montréal (CA); Richard Paré, Boucherville (CA)

(73) Assignee: CASCADES CANADA ULC, Kingsey Falls (CA)

( * ) Notice: Subject to any disclaimer, the term of this patent is extended or adjusted under 35 U.S.C. 154(b) by 365 days.

(21) Appl. No.: 18/545,080

(22) Filed: Dec. 19, 2023

(65) Prior Publication Data

US 2024/0197121 A1 Jun. 20, 2024

Related U.S. Application Data

(60) Provisional application No. 63/476,003, filed on Dec. 19, 2022.

(51) Int. Cl.
*A47K 10/38* (2006.01)

(52) U.S. Cl.
CPC ..... *A47K 10/3845* (2013.01)

(58) Field of Classification Search
None
See application file for complete search history.

(56) References Cited

U.S. PATENT DOCUMENTS 1,055,576 A 3/1913 Tyler
2,269,939 A 1/1942 Janisch
2,699,903 A 1/1955 Montgomery
2,707,595 A 5/1955 Brown
2,928,619 A 3/1960 Burton
3,083,928 A 4/1963 Voissem
3,606,195 A * 9/1971 Freeman, Jr. et al. . B65H 75/14 242/118.41

(Continued)

FOREIGN PATENT DOCUMENTS

EP 3698691 A1 8/2020
EP 3714751 B1 9/2020

(Continued)

*Primary Examiner* — William A. Rivera
(74) *Attorney, Agent, or Firm* — MARSHALL, GERSTEIN & BORUN LLP

(57) ABSTRACT

A bushing for a rolled product having roll of web material defining a hollow center portion. The bushing includes a cylindrical body sized to be press-fitted into an extremity of the hollow center portion of the roll of web material; and an end wall fixed to the cylindrical body for closing at least partially its extremity and having a central pin-receiving hole extending therethrough and a curved rib projecting outwardly and encircling partially the pin-receiving hole. It also concerns a rolled product dispenser, including: a pair of support members for supporting a rolled product inbetween. At least one of the support members includes a rolled product connector comprising a base wall, an outer wall structure and a platform, each one protruding from the base wall and being spaced-apart from one another to define a recess inbetween, and a pin protruding from the platform. The pin is engageable in a pin-receiving hole of a bushing of the rolled product and to allow the rolled product to rotate once the bushing is engaged with the pin.

20 Claims, 17 Drawing Sheets

(56) References Cited

U.S. PATENT DOCUMENTS

| | | | | |
|---|---|---|---|---|
| 3,627,220 | A | 12/1971 | Vogel | |
| 3,650,487 | A | 3/1972 | Bahnsen | |
| 3,840,194 | A | 10/1974 | Vetter | |
| 3,991,878 | A | 11/1976 | Serio, Jr. | |
| 4,015,711 | A | 4/1977 | Mason | |
| RE30,168 | E | 12/1979 | Mason | |
| 4,422,585 | A | 12/1983 | Schultz | |
| D277,454 | S | 2/1985 | Meinhardt | |
| D279,164 | S | 6/1985 | Mitchell | |
| 4,659,031 | A | 4/1987 | Saraisky | |
| 4,872,601 | A | 10/1989 | Sigmund | |
| 5,310,129 | A | 5/1994 | Whittington | |
| 5,322,234 | A | 6/1994 | Robert | |
| 5,370,339 | A | 12/1994 | Moody | |
| 5,451,013 | A | 9/1995 | Schutz | |
| 5,628,474 | A | 5/1997 | Krueger | |
| 5,873,542 | A | 2/1999 | Perrin | |
| D443,858 | S | 6/2001 | Treiger | |
| D447,930 | S | 9/2001 | Larson | |
| 6,378,800 | B1 | 4/2002 | Apichom | |
| 6,390,428 | B1 | 5/2002 | Oshima | |
| D466,391 | S | 12/2002 | Votruba | |
| 6,575,523 | B2 | 6/2003 | Votruba | |
| 6,592,067 | B2 | 7/2003 | Denen | |
| 6,648,281 | B1 | 11/2003 | Lake | |
| 6,709,100 | B2 | 3/2004 | Kalbach | |
| D488,715 | S | 4/2004 | Plumer | |
| 6,752,349 | B2 | 6/2004 | Moody | |
| 7,191,979 | B2 | 3/2007 | Paukov | |
| 7,364,112 | B1 * | 4/2008 | Formon | A47K 10/3836 242/564.1 |
| 7,431,236 | B2 | 10/2008 | Larsson | |
| 7,461,810 | B2 | 12/2008 | Goeking | |
| 7,537,180 | B2 | 5/2009 | Morand | |
| D601,930 | S | 10/2009 | Chen | |
| D607,830 | S | 1/2010 | Shaw | |
| D608,294 | S | 1/2010 | Shaw | |
| D608,353 | S | 1/2010 | Tsai | |
| D614,584 | S | 4/2010 | Neitzel | |
| D626,091 | S | 10/2010 | Neitzel | |
| 7,832,678 | B2 * | 11/2010 | Hjort | A47K 10/38 242/560.3 |
| 7,866,593 | B2 | 1/2011 | Friesen | |
| 7,878,444 | B2 | 2/2011 | Friesen | |
| 7,913,945 | B2 | 3/2011 | Friesen | |
| 7,967,235 | B2 | 6/2011 | Forman | |
| D643,335 | S | 8/2011 | Pontaoe | |
| 8,096,495 | B2 | 1/2012 | Billman | |
| D661,256 | S | 6/2012 | Shawgo | |
| D675,985 | S | 2/2013 | Izen | |
| D679,660 | S | 4/2013 | Haberek | |
| D680,963 | S | 4/2013 | Purdy | |
| D706,117 | S | 6/2014 | Toimil | |
| 8,764,480 | B2 | 7/2014 | Natoli | |
| D714,220 | S | 9/2014 | Izen | |
| 8,910,803 | B2 | 12/2014 | Holtby | |
| 9,066,638 | B2 | 6/2015 | Lowery | |
| 9,138,110 | B2 | 9/2015 | Knight | |
| 9,241,601 | B2 | 1/2016 | Case | |
| 9,271,616 | B2 | 3/2016 | Yaros | |
| D790,873 | S | 7/2017 | Ku | |
| 9,738,487 | B2 | 8/2017 | Gaumann | |
| 9,770,142 | B2 | 9/2017 | Ochoa, Sr. | |
| D798,630 | S | 10/2017 | Kovaleff | |
| 9,796,553 | B2 | 10/2017 | Balsells | |
| D813,015 | S | 3/2018 | O'Brien et al. | |
| 10,045,669 | B2 | 8/2018 | Morand | |
| 10,201,254 | B2 | 2/2019 | Hudkins | |
| 10,238,246 | B2 | 3/2019 | Cittadino | |
| D852,612 | S | 7/2019 | Paik | |
| D876,932 | S | 3/2020 | Franta | |
| D888,518 | S | 6/2020 | Shih | |
| D889,943 | S | 7/2020 | Phillips | |
| 10,710,832 | B2 | 7/2020 | Rozek | |
| 10,765,272 | B2 | 9/2020 | Mattheeussen | |
| 10,806,306 | B2 | 10/2020 | Morand | |
| D907,473 | S | 1/2021 | Bailey | |
| D911,822 | S | 3/2021 | Bailey | |
| D913,248 | S | 3/2021 | Voelzke | |
| D914,488 | S | 3/2021 | Roberts | |
| D914,489 | S | 3/2021 | Roberts | |
| D915,187 | S | 4/2021 | Huang | |
| D915,188 | S | 4/2021 | Huang | |
| D928,594 | S | 8/2021 | Pare | |
| 11,369,238 | B2 | 6/2022 | Pare | |
| 11,412,900 | B2 | 8/2022 | Swanson | |
| 11,529,029 | B2 | 12/2022 | Wicker | |
| D995,142 | S | 8/2023 | Chalko | |
| 11,737,614 | B2 | 8/2023 | Mainville | |
| 11,759,061 | B2 | 9/2023 | Williams, Jr. | |
| 11,766,154 | B2 | 9/2023 | Grosz, Jr. | |
| 11,807,478 | B2 | 11/2023 | Guidi | |
| D1,011,074 | S | 1/2024 | Chalko | |
| D1,014,235 | S | 2/2024 | Toshima | |
| 2006/0236836 | A1 | 10/2006 | Cassia | |
| 2008/0302810 | A1 | 12/2008 | Friesen | |
| 2009/0044481 | A1 | 2/2009 | Turek | |
| 2011/0041458 | A1 | 2/2011 | Yu Chen | |
| 2011/0101152 | A1 | 5/2011 | Molstad | |
| 2011/0210198 | A1 * | 9/2011 | Case | A47K 10/38 242/598 |
| 2012/0138723 | A1 | 6/2012 | Lewis | |
| 2013/0040794 | A1 | 2/2013 | Paoletti | |
| 2014/0001304 | A1 * | 1/2014 | Moller | A47K 10/38 242/596.7 |
| 2015/0083847 | A1 * | 3/2015 | Cittadino | A47K 10/24 242/597 |
| 2015/0150422 | A1 * | 6/2015 | Ochoa, Sr. | A47K 10/16 242/596.7 |
| 2015/0374181 | A1 * | 12/2015 | Morand | A47K 10/38 242/423 |
| 2016/0157682 | A1 * | 6/2016 | Keily | A47K 10/38 242/563.2 |
| 2017/0071419 | A1 * | 3/2017 | Gscheidmeier | A47K 10/38 |
| 2019/0075980 | A1 | 3/2019 | Xu | |
| 2019/0276259 | A1 * | 9/2019 | Paré | B65H 16/04 |

FOREIGN PATENT DOCUMENTS

| | | | |
|---|---|---|---|
| WO | WO-2014021146 | A1 | 2/2014 |
| WO | WO-2018127618 | A1 | 7/2018 |

* cited by examiner

ROLLED PRODUCT DISPENSER AND BUSHING FOR A ROLLED PRODUCT

CROSS REFERENCE TO RELATED APPLICATION

The present application claims the benefit of the filing date of U.S. provisional patent application No. 63/476,003, filed on Dec. 19, 2022, and entitled "BUSHING AND SUPPORT MEMBER FOR A PAPER ROLL AND ASSOCIATED CAPTIVITY ASSEMBLY", the disclosure of which being hereby incorporated by reference in its entirety.

TECHNICAL FIELD

The present disclosure generally relates to the field of dispensers and, more particularly, it relates to a dispenser for rolled products such as rolled paper products.

BACKGROUND

Several types of rolled product dispensers exist in the prior art. These systems are used to gradually provide to a user of the dispenser different types of products rolled around a hollow center portion, hereinafter referred to as a "rolled product". The most common of these dispensers dispenses paper items such as paper towels and toilet paper. These dispensers are often used in public area washrooms.

Already known in the prior art are rolled product dispensers provided with fitting pieces, such as bushings, permanently or removably placed in an extremity of the hollow center portion of the rolled products to prevent rolls from being misplaced or installed onto an incompatible dispenser.

Further types of known rolled product dispensers are used to discriminate against incompatible and unwanted rolled products, for example, to better control quality and reduce maintenance costs. Another purpose of this type of dispenser is to ensure a sale's exclusive right for roll replacement. Systems designed to discriminate against unwanted rolled products or dispensers are generally referred as "captivity systems."

It is advantageous for several different reasons, including quality control, reduced maintenance and repair costs for dispensers, to further develop "captivity systems" for rolled product dispensers so that rolled product dispensers can only operate with rolled products specifically designed for use in the dispensers, and so that rolled products can only operate with specifically designed dispensers. Although, various prior art devices have been developed in recent years for this specific purpose, there is still a need for improved captivity systems, which can reduce the occurrences of damage to the dispenser caused by the installation of an incompatible roll product in the dispenser.

BRIEF SUMMARY

It is therefore an aim of the present disclosure to at least partially address the above-mentioned need.

According to a general aspect, there is provided a bushing for a rolled product having a hollow center portion, such as a paper roll core. The bushing comprises a cylindrical body and an end wall. The cylindrical body is sized to be press-fitted into an extremity of the hollow center portion of the rolled product. The end wall is fixed to the cylindrical body for closing at least partially the extremity of the hollow center portion of the rolled product. The end wall has a central pin-receiving hole extending therethrough, an outer surface, and a curved rib projecting outwardly from the outer surface of the end wall and encircling partially the central pin-receiving hole.

According to another general aspect, there is also provided a rolled product, such as a paper roll, comprising: a roll of web material defining a hollow center portion with two opposite extremities; and a bushing comprising: a cylindrical body press-fitted into one of the extremities of the hollow center portion of the roll of web material; and an end wall fixed to the cylindrical body for closing at least partially the extremity of the hollow center portion of the roll of web material. The end wall has a central pin-receiving hole extending therethrough, an outer surface, and a curved rib projecting outwardly from the outer surface and encircling partially the central pin-receiving hole.

According to yet another general aspect, there is provided a combination of a paper roll dispenser with a rolled product as defined above. The dispenser comprises a pair of support members for supporting the extremities of the rolled product inbetween. At least one of the support members comprises a base wall, an outer wall structure and a platform, each one protruding from the base wall and being spaced-apart from one another to define a recess inbetween, and a pin protruding from the platform. The outer wall structure is located outwardly with respect to the platform. The platform has a lower side wall having a shape conforming with the at least one rib of the bushing. The pin is configured to be engaged in the pin-receiving hole of the bushing and to allow the bushing to rotate once engaged with the pin. In an embodiment, the platform has a central axis offset downward with respect to a central axis of the pin.

In an embodiment, the curved rib forms a C-shape.

In an embodiment, the curved rib comprises a single rib segment.

In an embodiment, the curved rib comprises a plurality of spaced-apart rib segments equally distributed around the central pin-receiving hole.

In an embodiment, the end wall comprises a centrally located outwardly protruding part comprising a planar wall portion encircling the pin-receiving hole, the curved rib protruding outwardly from the planar wall portion.

In an embodiment, the curved rib has at least two adjacent ends with an opening defined inbetween.

According to yet a further general aspect, there is provided a rolled product dispenser, comprising: a pair of support members for supporting a rolled product inbetween. At least one of said support members comprises a rolled product connector comprising a base wall, an outer wall structure and a platform, each one protruding from the base wall and being spaced-apart from one another to define a recess inbetween, and a pin protruding from the platform. The outer wall structure is located outwardly with respect to the platform. The platform has a lower side wall extending below the pin. The pin is engageable in a pin-receiving hole of a bushing of the rolled product and to allow the rolled product to rotate once the bushing is engaged with the pin.

outer surface, and a curved rib projecting outwardly from the outer surface of the end wall and encircling partially the central pin-receiving hole.

According to another general aspect, there is also provided a rolled product, outer surface, and a curved rib projecting outwardly from the outer surface of the end wall and encircling partially the central pin-receiving hole.

According to another general aspect, there is also provided a rolled product, such as a paper roll, comprising: a roll of web material defining a hollow center portion with two opposite extremities; and a bushing comprising: a cylindrical body press-fitted into one of the extremities of the hollow center portion of the roll of web material; and an end wall fixed to the cylindrical body for closing at least partially the extremity of the hollow center portion of the roll of web material. The end wall has a central pin-receiving hole extending therethrough, an outer surface, and a curved rib projecting outwardly from the outer surface and encircling partially the central pin-receiving hole.

In an embodiment, the curved rib forms a C-shape.

In an embodiment, the curved rib comprises a single rib segment.

In an embodiment, the curved rib comprises a plurality of spaced-apart rib segments equally distributed around the central pin-receiving hole.

In an embodiment, the end wall comprises a centrally located outwardly protruding part comprising a planar wall portion encircling the pin-receiving hole, the curved rib protruding outwardly from the planar wall portion.

In an embodiment, the outer wall structure at least partially surrounds the platform.

In an embodiment, the outer wall structure includes at least two sections, each one extending on a respective lateral side of the pin.

According to yet another general aspect, there is provided a combination of a paper roll dispenser with a rolled product as defined above. The dispenser comprises a pair of support members for supporting the extremities of the rolled product inbetween. At least one of the support members comprises a base wall, an outer wall structure and a platform, each one protruding from the base wall and being spaced-apart from one another to define a recess inbetween, and a pin protruding from the platform. The outer wall structure is located outwardly with respect to the platform. The platform has a lower side wall extending below the pin. The pin is engageable in the pin-receiving hole of the bushing of the rolled product with the curved rib of the bushing being inserted in the recess and to allow the bushing to rotate once engaged with the pin. In an embodiment, the platform has a central axis offset downward with respect to a central axis of the pin.

In an embodiment, the lower side wall of the platform defines an arc of a circle with a center thereof being concentric a center of the pin; and wherein the curved rib has a radius greater than a radius of the arc of the circle of the lower side wall.

In an embodiment, the outer wall structure surrounds at least partially the platform and the bushing is freely rotatable about the pin with the curved rib remaining fully inserted in the recess.

In an embodiment, the outer wall structure includes at least two sections, each one extending on a respective lateral side of the pin.

In an embodiment, the curved rib has at least two adjacent ends with an opening defined inbetween and a length of the opening is longer than a diameter of the pin.

In an embodiment, the curved rib has an outer radius and the outer radius is smaller than a distance between a center of the pin and the outer wall structure and the inner radius is greater than a distance between a center of the pin and a nadir of the lower side wall of the platform.

BRIEF DESCRIPTION OF THE DRAWINGS

FIG. 4 includes FIGS. 4*a*, 4*b* and 4*c* which are

DETAILED DESCRIPTION

In the following description, although the embodiments of a bushing, a support member including a rolled product connector, and a rolled product dispenser and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the bushing, the rolled product connector, and the rolled product dispenser, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

As will be explained below in relation to various embodiments, the present disclosure describes a captivity assembly 1 (FIG. 11) for ensuring that a given bushing for a rolled product, such as a paper roll, is used with a compatible rolled product dispenser and vice versa. It is understood that the captivity assembly 1 described herein does not pretend to teach a full proof captivity assembly insofar that it may be possible for an embodiment of a bushing described herein to be used within a dispenser having a configuration that is not described herein. However, the configurations provided herein diminish the working compatible options available for the bushings and rolled product connectors described hereunder, thus establishing a level of captivity.

Figure 1:
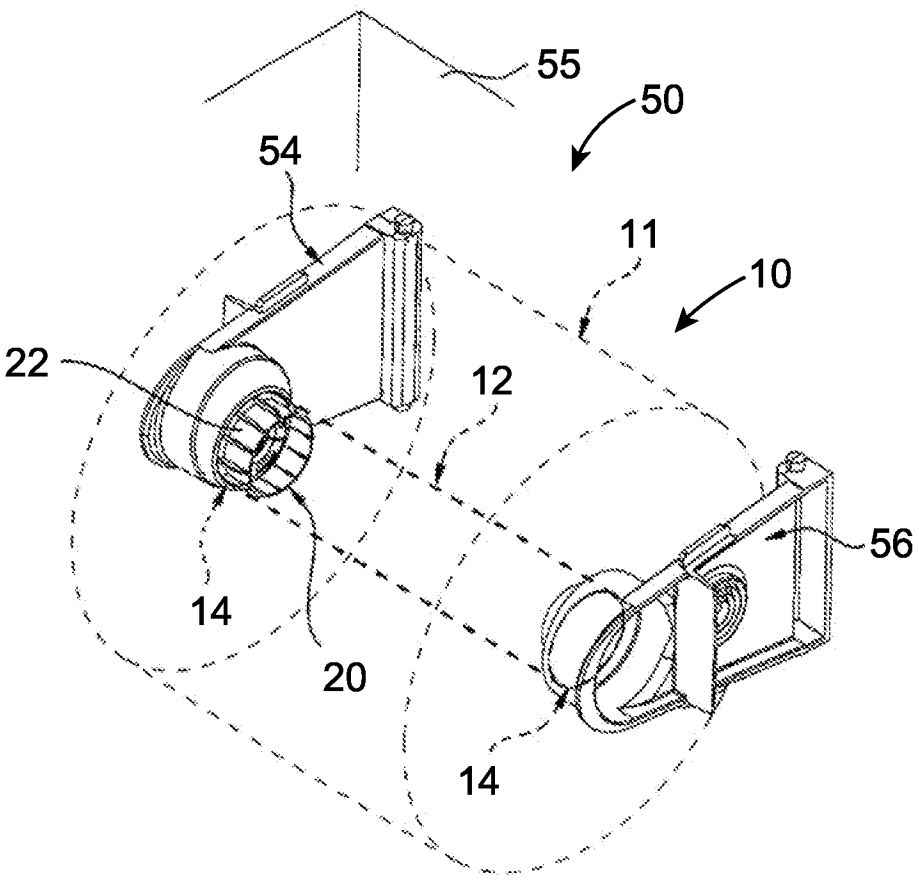
Fig. 1 (PRIOR ART)
FIG. 1 is a perspective view of a portion of a rolled product dispenser having rolled product mounted between support members of the dispenser in accordance with an embodiment of the prior art.

Referring to the FIG. 1, there is shown a rolled product dispenser 50 configured to dispense a rolled product 10. The rolled product 10 can be a web of absorbent sheet product provided in rolled configuration, such as and without being limitative, hand paper towel. However, the rolled product 10 can be any type of paper provided in a roll, such as, but without being limitative, toilet paper, or other types of rolled product, such as cling film, foil or the like.

The rolled product dispenser 50 includes a housing 55 (only a portion thereof being shown in FIG. 1) defining a dispensing assembly chamber and including a rolled product support with two spaced-apart support members 54, 56 extending in the dispensing assembly chamber. The dispensing assembly chamber in combination with the support members 54, 56 are configured to contain the rolled product 10 and a dispensing assembly (not shown). As shown in FIG. 1, the rolled product 10 is mounted to and extends between the two support members 54, 56 of the dispenser 50.

The dispenser 50 is configured to dispense lengths of the web of the rolled product 10 to a user. The rolled product 10 rotates about its rotation axis, supported by the support members 54, 56.

Again referring to the embodiment illustrated in FIG. 1, the rolled product 10 including a roll of web material 11 defining a hollow center portion 12 with two opposite extremities 14 and a bushing 20 having a cylindrical body 22 sized to be press-fitted into one of the extremities 14 of the hollow center portion 12. It is understood that each one of the extremities 14 of the hollow center portion 12 can have one of the bushing 20 press-fitted therein. In the embodiment shown, only one extremity 14 of the hollow center portion 12 is provided with the bushing 20 and when the rolled product 10 is mounted in the dispenser 50, the bushing 20 is engaged with one of the support members of the dispenser 50, in this case the support member referenced 54. The other extremities 14 can have another bushing mounted thereto for engaging this extremity of the roll product 10 with the support member 56 of the dispenser 50 or can be directly engaged with the support member 56.

It is appreciated that the expression "hollow center portion", as used herein with regard to the roll of web material 11, is to be understood as a cavity (or at least a partial cavity) having a substantially cylindrical shape defined about a longitudinal axis of the roll of web material 11. According to one embodiment, the rolled product 10 includes a core, i.e. a tubular support about which the web material is wound and which is commonly known in the tissue products industry as a paper roll "core". The paper roll core is generally made of cardboard material but it could be made of any other suitable material. According to another embodiment, the rolled product 10 is exempt of a physical core. The hollow center portion 12 is particularly defined by the web material wound around itself to obtain the rolled product 10 such that a cavity is formed about its longitudinal axis, which is commonly known in the paper dispensing industry as a "coreless" rolled product 10. Regardless of whether the rolled product 10 embodiment has a core or is coreless, the bushing 20 can be press-fitted in the opposite extremities 14 of the hollow center portion 12 of the rolled product 10, particularly to engage an inner edge thereof. For the sake of simplicity, only the support member referenced as 54 will be described hereinafter but it is worth mentioning that if the other extremity of the hollow center portion 12 was provided with another one of the bushing 20, the support member referenced 56 could feature the same characteristics as support member 54 described below. In a non-limitative embodiment, the two support members 54, 56 can be characterized by a different shape and/or a different configuration.

It is worth mentioning that the cylindrical body 22 of the bushing 20 can be press-fitted (i.e., engaged) in either one or both of the extremities 14 of the hollow center portion 12 without departing from the scope of the present disclosure.

It should be noted that the illustrative dispenser shown in FIG. 1 is provided to illustrate the general relative positions and/or interconnections of various features of the captivity assembly 1 within the rolled product dispenser 50. The exemplary illustration of FIG. 1 should not be construed as being limitative in regard to the configurations of the bushing 20 and the support member 54.

Figure 2A:
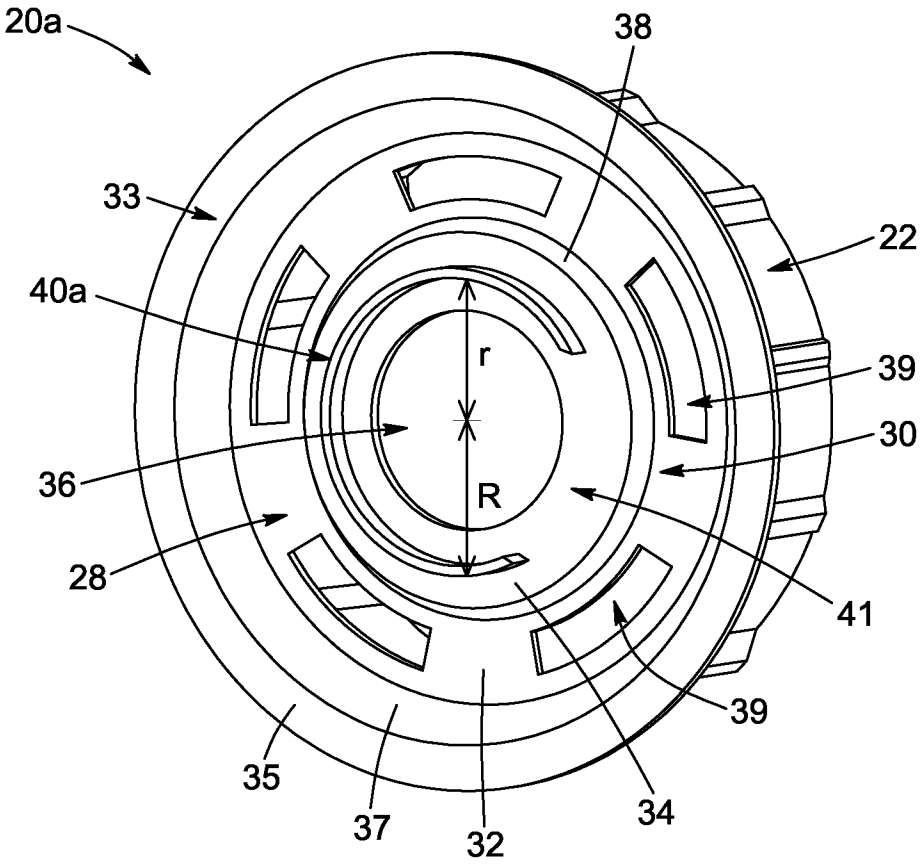
FIG. 2*a* is a front perspective view of a bushing, in accordance with an embodiment, wherein the bushing includes an end wall with a C-shaped rib.
Figure 2B:
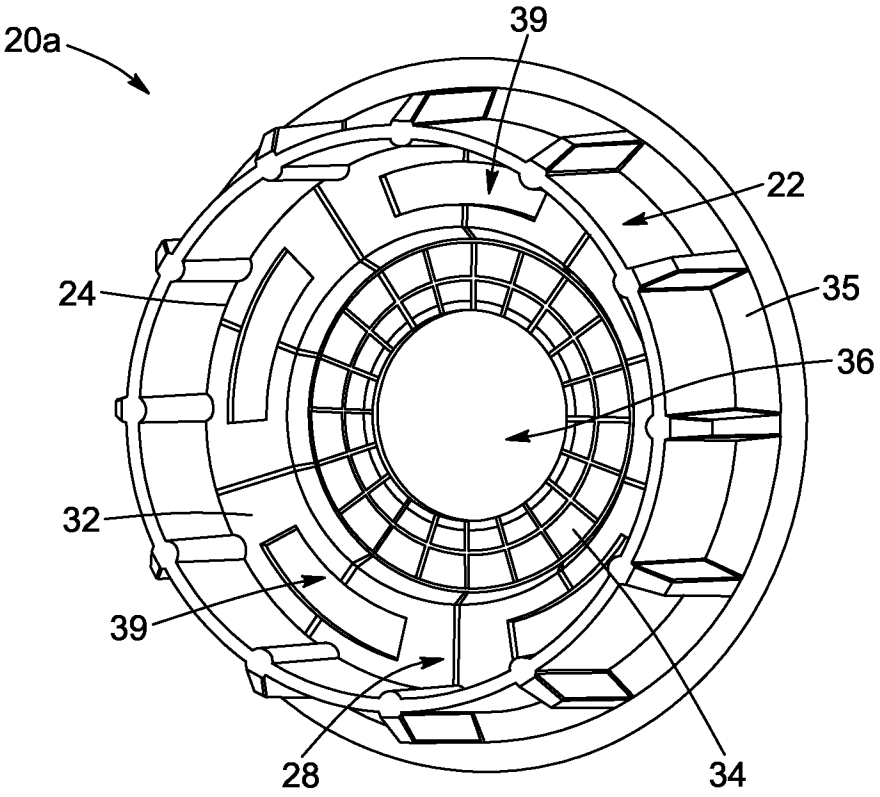
FIG. 2*b* is a rear perspective of the bushing shown in FIG. 2*a;*

The bushing 20 of the captivity assembly 1 will now be described in more details. Referring to FIGS. 2*a* and 2*b*, there is shown a non-limitative embodiment of the bushing 20*a* including a cylindrical body 22 and an end wall 28 extending substantially normal to the cylindrical body 22 at a first end 24 (FIG. 2*b*) thereof. The end wall 28 of the bushing 20*a* shown is sized and shaped to engage a corresponding support member 54 of the rolled product dispenser 50. More specifically, the end wall 28 includes a central pin-receiving hole 36 sized and shaped to engage a pin 70 (FIG. 11) of the support member 54, to allow a rotation of the bushing 20*a* thereon, thus permitting the unrolling of the rolled product 10 (not shown) fitted with the bushing 20.

The end wall 28 at least partially closes the extremity 14 of the hollow center portion 12 when the bushing 20*a* is engaged therewith. In the non-limitative embodiment shown, a diameter of the end wall 28 is slightly greater than a diameter of the cylindrical body 22.

In the description and in reference to the bushing 20, the terms "outwardly" and "inwardly" refer to a position of a component of the bushing 20 when mounted into the extremity 14 of the hollow center portion 12, with a position of the hollow center portion 12 as a reference point, and with "outwardly" meaning away from the hollow center portion 12, or alternatively meaning towards the support member 54 if the bushing 20 is engaged therewith. The term "centrally", as it is used herein, refers to a position of a component of the bushing 20 towards a center thereof (or a rotation axis of the bushing 20 when mounted into the hollow center portion 12) as a reference point and with "peripherally"/"periphery" meaning away from the center of the bushing 20.

Referring to FIG. 2*a* showing an outer face of the bushing 20*a*, the end wall 28 includes, sequentially from a center to a periphery thereof, a centrally located outwardly protruding portion 30 (the protruding part 30) in which the pin-receiving hole 36 is defined, an annular planar wall section 32 surrounding the protruding part 30, and a rim portion 33. The protruding part 30 includes a substantially planar wall portion 34 encircling the pin-receiving hole 36 and a protruding wall portion 38 extending inwardly from the planar wall portion 34 towards the surrounding section of the end wall 28. The protruding wall portion 38 connects the central planar wall portion 34 to the planar wall section 32 of the end wall 28. The annular planar wall section 32 circumscribes the planar wall portion 34 but is offset along a rotation axis of the bushing 20*a*. Finally, the rim portion 33 includes a planar peripheral rim 35 circumscribing the planar wall section 32 and offset thereof along the rotation axis of the bushing 20*a* and a connecting wall 37 extending between an outer edge of the planar wall section 32 and an inner edge of the planar peripheral rim 35. The peripheral rim 35 is located outwardly of the planar wall section 32.

Turning now to FIG. 2*b* showing the inner face of the bushing 20*a*, there is shown that the first end 24 of the cylindrical body 22 connects an inner surface of the end wall 28, at a connection point offset from an outer edge of the rim portion 35.

The bushing 20*a* contains five apertures 39 defined in the annular planar wall section 32 of the end wall 28 (excluding the pin-receiving hole 36) peripherally to the pin-receiving hole 36. It is appreciated that these apertures 39 defined in the bushing 20*a* do not contribute to the captivity of the assembly. Therefore, the shape, the configuration, and the number of apertures 39 defined in the end wall 28 can vary from the embodiment shown to be higher or lower. In an alternative embodiment (not shown), the bushing 20*a* can be free of apertures provided peripherally to the pin-receiving hole 36.

Figure 11:
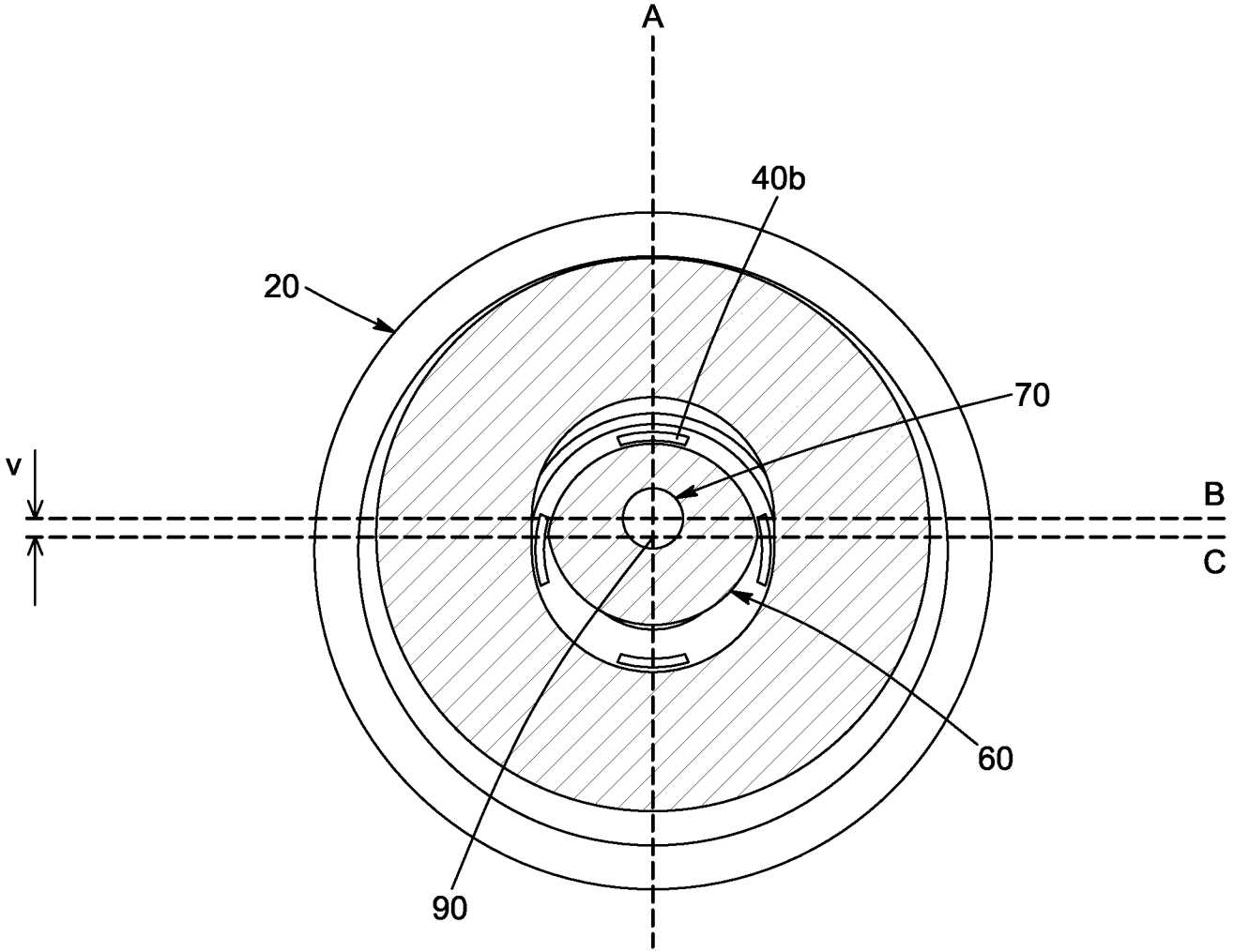
FIG. 11 is a schematic view of the bushing, in accordance with an embodiment and including four curved rib segments engaged with the rolled product connector including a football-shaped platform in the "offset" configuration.

At least partially to provide the captivity assembly 1 (an embodiment of which is shown in FIG. 11), the bushing 20 and the support member 54 are each complementarily sized and shaped according to a captivity configuration configured to limit the combination of compatible bushing 20 and support member 54. As explained in more details below, a few non-limitative embodiments of the bushing 20 and the support member 54 are shown in FIGS. 2*a* to 4*c* and FIGS. 5 to 8 and 12 respectively, each one providing a different embodiment of the captivity assembly 1.

Referring back to FIG. 2*a*, there is shown that the captivity assembly 1 associated to the bushing 20*a* and, more particularly, the end wall 28 of the bushing 20 includes one curved rib 40*a*, projecting outwardly from the planar wall portion 34, from an outer face thereof, and configured to partially encircle the pin-receiving hole 36.

The curved rib 40*a* substantially follows the shape of the letter "C" 40*a* (hereinafter, the "C-shaped rib" 40*a*). In other words, the C-shaped rib 40*a* conforms to the shape of a ring characterized by a rib radius "r" wherein an arc of the ring is removed, and the area that corresponds to the removed arc of the ring defines an opening 41. As explained in more details below, the opening 41 has a length (i.e., a length of the missing arc of the C-shaped rib 40*a*) longer than a diameter of a widest portion of the pin 70 of the support member 54 (see FIG. 5, for instance).

As it will be described in more details below, the size, the shape, and the location of the curved rib 40 can dictate the captivity of the bushing 20. The size of the bushing 20 includes its height (i.e. its axial depth) and its thickness. The location of the curved rib 40 on the end wall 28 of the bushing 20 can be characterized by the rib radius "r" (i.e. its location on the end wall 28 with respect to a center of the pin-receiving hole 36). It is appreciated that the shape, the location, and the size of the curved rib 40 can vary from the non-limitative embodiments shown herein.

In FIGS. 2*a* and 2*b*, the curved rib 40*a* is shaped as a single segment. However, it is appreciated that the bushing 20 can include more than one rib segment, as will be explained below in reference to FIG. 3.

Figure 3:
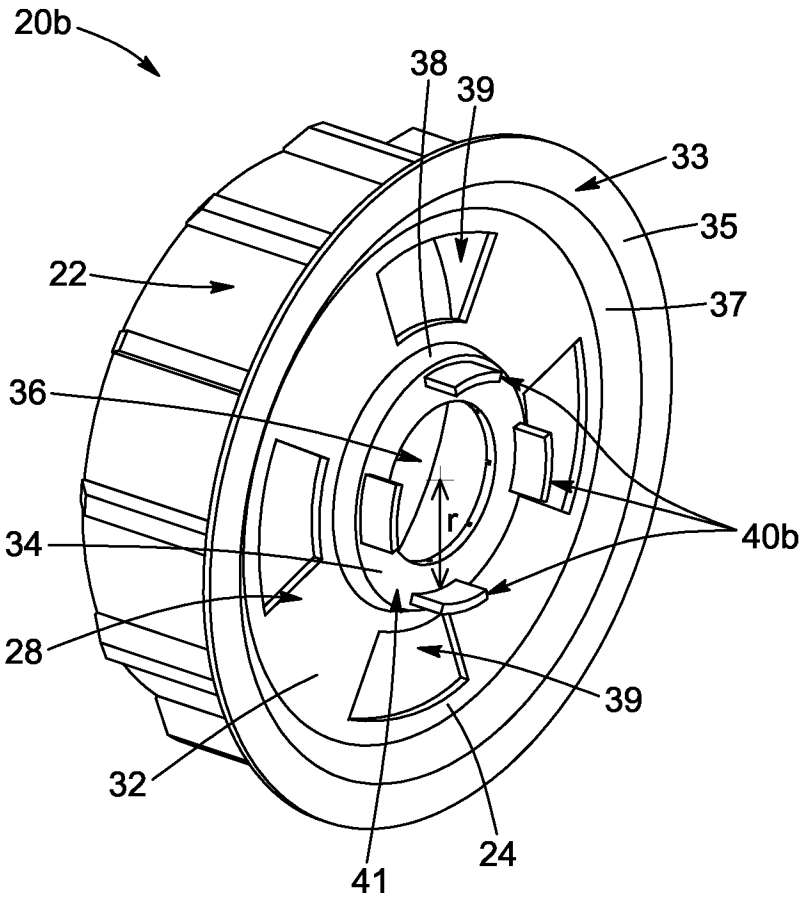
FIG. 3 is a front perspective view of the bushing, in accordance with another embodiment, wherein the end wall of the bushing includes a plurality of curved rib segments.

More particularly, the bushing 20*b*, shown in FIG. 3, is similar to the bushing 20*a* shown in FIGS. 2*a* and 2*b*, except for the number of apertures 39 defined in the planar wall section 32 and the shape and configuration of the projecting curved rib 40. Amongst others, the bushing 20*b* has four apertures 39 defined in the planar wall section 32 and includes a plurality of curved rib segments 40*b* projecting outwardly from the outer face of the planar wall portion 34. Indeed, the end wall 28 of the bushing 20*b* has a plurality of spaced-apart rib segments 40*b* (four in this case, but the exact amount may vary in other embodiments) equally distributed along an imaginary circle characterized by the rib radius "r" extending around the pin-receiving hole 36 (i.e. each rib segment 40*b* is equidistant to the center of the pin-receiving hole 36). It should be noted that the term "equally distributed" as used herein in the context of the rib segments 40*b* is to be understood as a distance between each pair of adjacent rib segments being substantially equal. A plurality of openings 41 is defined between adjacent rib segments 40*b* and a length of the openings 41 is greater than a diameter of the pin 70 (FIG. 5) of the support member 54, either a stem or a head thereof, as will be described in more details below. In an alternative embodiment (not shown), the plurality of rib segments 40*b* can be distributed equidistant to the center of the pin-receiving hole 36, but without being distributed equally one from another. In such embodiment, at least one of the opening(s) 41 has a length greater than the diameter of the pin 70 (FIG. 5) of the support member 54, either a diameter of the stem or the head thereof.

It should be noted that the shape of the curved rib 40, either the single segment curved rib 40*a* (FIG. 2*a*), or the curved rib defined by a plurality of segments (FIG. 3), can differ from the embodiments shown. For instance, the segments of the curved rib 40*b* do not necessarily have to be curved to engage with the support member 54. For instance, a non-limitative implementation of the curved rib can comprise a plurality of substantially straight spaced-apart segments of relatively short lengths (not shown), configured along an imaginary circle of rib radius "r", which are engageable with the support member 54, provided that the support member 54 is configured accordingly and that the substantially straight spaced-apart rib segments are not so long as to impede the engagement with the support member 54.

For simplicity, the rest of the disclosure refers to a curved rib 40, which includes a single rib segment, as exemplified in FIG. 2*a*, or a plurality of rib segments, as shown in FIG. 3, unless indicated otherwise. However, this terminology shall not be interpreted as being limiting since any contemplated configuration of a single curved rib 40 protruding from the planar wall portion 34 can be achieved with a subset of rib segments, each one being straight or curved.

As mentioned above, the location of the curved rib 40 and simultaneously the rib radius "r" can vary. Referring to the non-limitative embodiments of FIGS. 4*a* to 4*c*, it is shown that the curved rib 40', 40", 40'" can be positioned at various locations on the planar wall portion 34 of the end wall 28 of the bushing 20. For the sake of simplicity, in FIGS. 4*a* to 4*c*, the curved rib 40', 40", 40'" is represented as a complete closed circle, i.e. the imaginary circle along a portion of which the curved rib 40', 40", 40'" extends. Even if the curved rib 40', 40", 40'" is represented as a complete circle, emphasized in bold, in FIGS. 4*a* to 4*c*, it is appreciated that the curved rib 40', 40", 40'" can be shaped as an incomplete portion of a circle, i.e. an arc of a circle, as shown for in FIG. 2*a* or 3 and the alternative embodiments described above. Amongst other, the curved rib 40', 40", 40'" includes at least one opening (not shown), such as opening(s) 41 shown in FIGS. 2*a* and 3, and having a length greater than a widest diameter of the pin 70 of the support member 54.

Figure 4A:
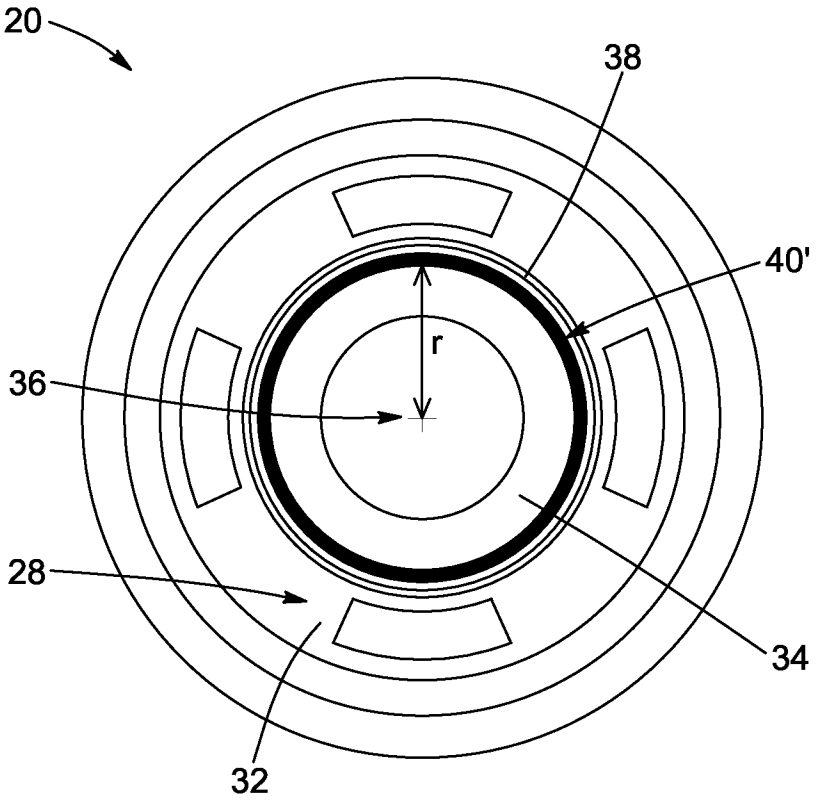
FIG. 4*a* is a first front elevation view of the bushing, in accordance with another embodiment, showing a first possible location for the curved rib, wherein the curved rib is located close to an outer edge of a planar wall portion of the end wall (FIG. 4*a*)
Figure 4B:
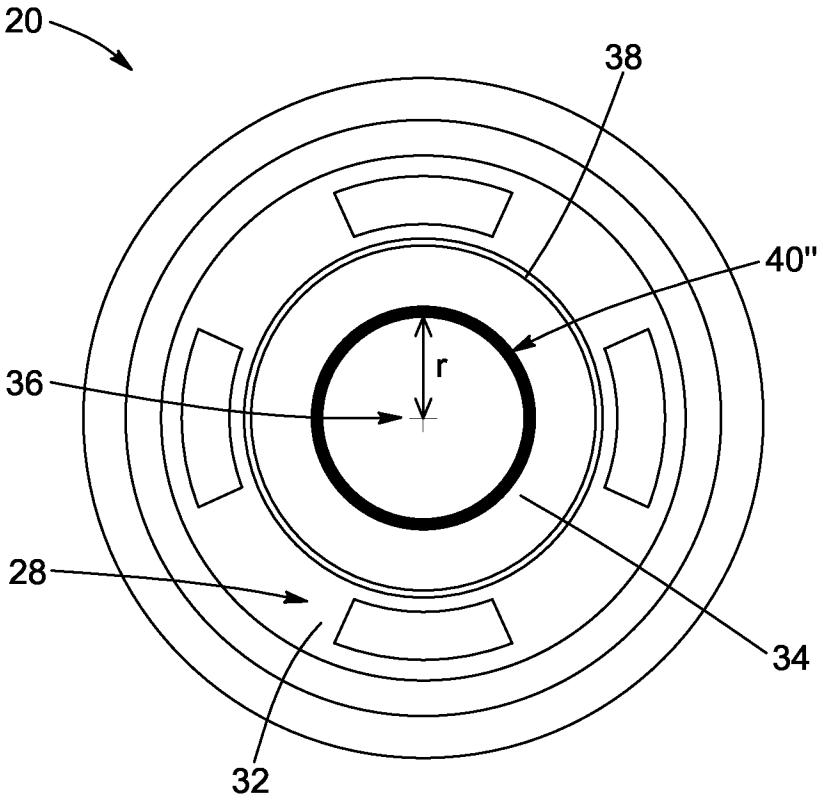
FIG. 4*b* a second front elevation view of the bushing, in accordance with yet another embodiment, showing a second possible location for the curved rib, wherein the curved rib is close to an inner edge of the planar wall portion (FIG. 4*b*)
Figure 4C:
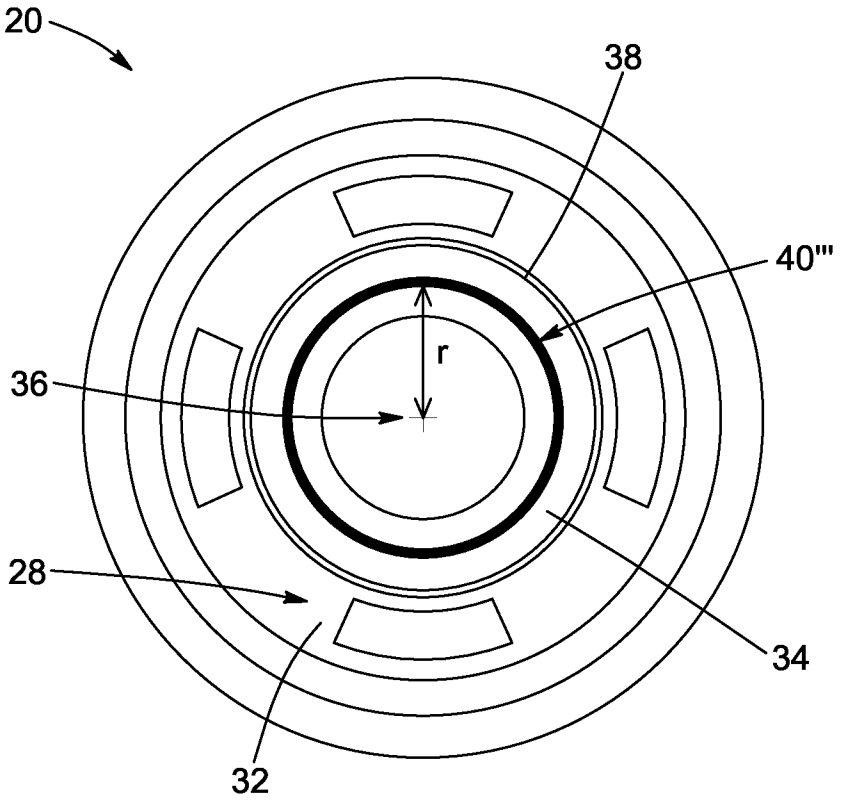
FIG. 4*c* is a third front elevation view of the bushing, in accordance with another embodiment, showing a third possible location for the curved rib, wherein the curved rib is in between the inner and outer edges of the planar wall portion.

FIGS. 4*a* to 4*c* show different embodiments of the bushing 20, wherein most characteristics are identical except for the location of the curved rib 40', 40", 40'" on the end wall 28 and, consequently, by their rib radius "r". For all embodiments, the curved rib 40 is concentric with the pin-receiving hole 36 and protrudes outwardly from the planar wall portion 34. In FIG. 4*a*, the curved rib 40' is located close to an outer edge of the planar wall portion 34, comparable to a location of the spaced-apart rib segments 40*b* shown in FIG. 3. In FIG. 4*b*, the curved rib 40" is located close to an inner edge of the planar wall portion 34. In FIG. 4*c*, the curved rib 40'" projects from a location approximately in a middle of the central planar wall portion 34, i.e. in-between the inner and outer edges of the planar wall portion 34, which is comparable to a location of the C-shaped rib 40*a* shown in FIG. 2*a*. It will be understood that the expression "inner edge", as used herein in relation to the planar wall portion 34, is to be understood as an edge of the wall portion 34 delimiting or closer to the pin-receiving hole 36. It will also be understood that the expression "outer edge", as used herein, is to be understood as an intersection between the planar wall portion 34 and the angled wall portion 38.

It is understood that the shape and the configuration of the curved rib 40 at least partially circumscribing the pin-receiving hole 36 can vary from the non-limitative embodiments shown in FIGS. 2*a*, 3, and 4*a* to 4*c*. It is appreciated that the shape and configuration of the compatible support member 54, which will be described below, will vary accordingly.

In FIGS. 2*a*, 3, and 4*a* to 4*c*, the curved rib 40*a*, 40*b*, 40', 40", 40'" projects outwardly from the planar wall portion 34 of the bushing 20, 20*a*, 20*b*. However, it is appreciated that, in alternative embodiments (not shown), the location of the curved rib 40 and its rib radius "r" can differ. For instance, the curved rib 40 can project outwardly from any portion of the outer surface of the end wall 28. It is appreciated that the shape and configuration of the compatible support member 54, which will be described below, will vary accordingly. For instance and without being limitative, the curved rib 40 may project from the planar wall section 32 of the end wall 28. For instance, a plurality of curved rib segments may project from the planar wall section 32 in between the apertures 39.

Turning to FIGS. 5 to 8, non-limitative embodiments of the support member 54 of the dispenser 50 will now be described in more details. As mentioned above, the dispenser 50 includes the roll support with the two spaced-apart support members 54, 56. In the paragraphs below, only one of the two support members 54, 56 will be described. It is appreciated that the second support member 56 can mirror the first support member 54 or can differ from the first support member 54. It is understood that if the first and second support members 54, 56 share the same features, their design should mirror one another to enable a pair of bushings 20 mounted into each extremity 14 of the roll hollow center portion 12 to engage one support member 54, 56 in a same manner (e.g. first with each pin-receiving hole 36 of each one of the bushings 20 being inserted into a respective pin 70 of each support member 54, 56 such that the rolled product 10 can subsequently slide downwardly, as explained in more details below). Referring specifically to the embodiment represented in FIG. 5, the support member 54 includes an arm 100 with a flange 102 at a first end thereof and being securable to the housing 55 of the dispenser 50 (FIG. 1). The support member 54 includes a rolled product connector 65 protruding at a second end of the arm 100. The rolled product connector 65 protrudes towards the second support member of the dispenser 50 and is engageable with the rolled product 10. Thus, the rolled product connectors 65 of the two support members 54, 56, if any, face one another in the dispensing assembly chamber of the dispenser 50. More particularly, to engage the rolled product 10 between the two support members 54, 56, the rolled product connector 65 of the support member 54 is engaged with the bushing 20 inserted into the hollow center portion 12 of the rolled product 10, at a respective end thereof.

In the description and in reference to the support member 54, the terms "outwardly" and "inwardly" refer to a position of a component of the support member 54 with respect to a center of the rolled product connector 65 as a reference point, with "inwardly" meaning toward the center of the rolled product connector 65 and "outwardly" meaning away from the center of the rolled product connector 65.

Figure 5:
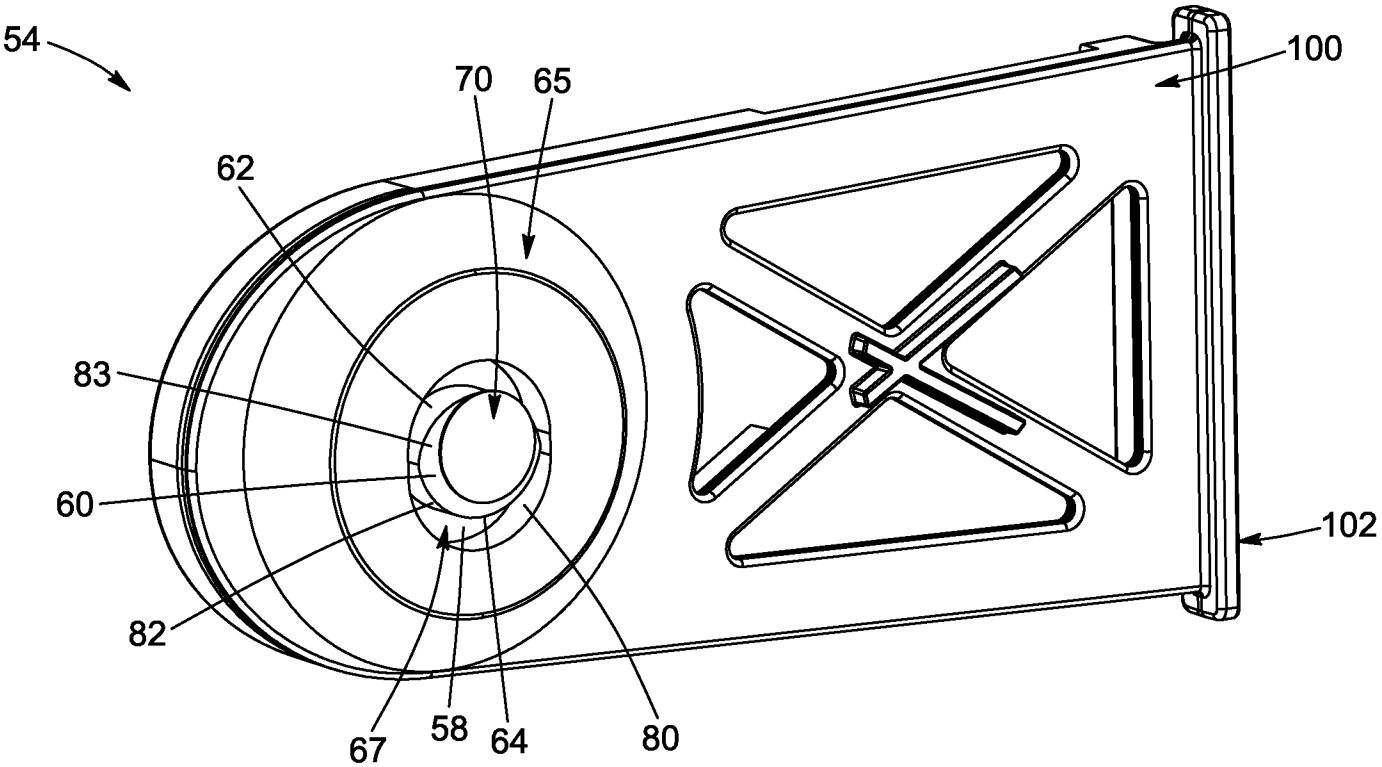
FIG. 5 is a front perspective view of a rolled product connector of a dispenser support member in accordance with an embodiment.

Still referring to FIG. 5, a non-limitative embodiment of the rolled product connector 65 will be described. It includes a pin 70 located substantially in a center thereof and surrounded by a recess 67. The pin 70 is designed to support at least partially the rolled product 10 having the bushing 20 mounted at least at one end thereof. More particularly, when the bushing 20 is engaged with the rolled product connector 65, the pin 70 of the rolled product connector 65 is inserted in the pin-receiving hole 36 of the bushing 20 is in a manner such that the bushing 20 can rotate about the pin 70.

The recess 67 is defined by an outer wall structure 80, a platform 60, and a base wall 58 connecting the outer wall structure 80 to the platform 60 at a bottom of the recess 67. Thus, both the outer wall structure 80 and the platform 60 protrudes from the base wall 58. The pin 70, which will be described in more details below in reference to FIG. 11, protrudes from the platform 60. The platform 60 of the rolled product connector 65 includes an inner peripheral wall 82 connected to the base wall 58 and a rim 83 from which the pin 70 protrudes.

Thus, the outer wall structure 80, the platform 60 and the pin 70 project (i.e., extend) from the base wall 58 and the outer wall structure 80 surrounds the platform 60 and is spaced-apart therefrom by the recess 67. In the non-limitative embodiment shown in FIG. 5, the outer wall structure 80 surrounds entirely the platform 60. However, as it will be described in more details below in reference to alternative embodiments, it is appreciated that the outer wall structure 80 can surround partially the platform 60 including extending along at least one side thereof. The recess 67 is sized in such a way to allow the curved rib 40 of a compatible bushing 20 to slidably engage therein. The recess 67 and its parameters are explained in more detail below in reference to FIG. 6*b*.

The outer wall structure 80, the platform 60, and thus the recess 67 surrounding the platform 67 are configured to discriminate against any incompatible bushing 20 by creating an interference with their curved rib 40, either upon engagement of the bushing 20 with the rolled product connector 65 and/or during rotation of the bushing 20 about the pin 70. For instance, if the curved rib 40 of a bushing 20 is characterized by an outer radius "R" (FIG. 2*a*) greater than a maximal acceptable radius, the curved rib 40 will interfere with the outer wall structure 80, preventing at least partially its engagement within the recess 67 and the engagement of the pin 70 within the pin-receiving hole 36 of the bushing 20. The term "outer radius" "R" as used herein with respect to the curved rib 40 corresponds to a distance from the center of the pin-receiving hole 36 to an outer wall surface of the curved rib 40. In other words, the outer radius "R' of the curved rib 40 is equal to the sum of the distance between the center of the pin-receiving hole 36 and an inner wall surface of the curved rib 40, and a thickness of the curved rib 40. Therefore, the outer wall structure 80 controls the maximal acceptable radius of the curved rib 40 of the complementary bushing 20.

On the contrary, if the curved rib 40 of a bushing 20 is characterized by an inner radius "r" smaller than a minimal acceptable radius, the curved rib 40 will interfere with the platform 60, preventing at least partially its engagement within the recess 67 and the engagement of the pin 70 within the pin-receiving hole 36 of the bushing 20. The term "inner radius" "r" as used herein with respect to the curved rib 40 corresponds to the distance from the center of the pin-receiving hole 36 to an inner wall surface of the curved rib 40. In other words, the inner radius "r" is equal to the difference between the outer radius "R" and the thickness of the curved rib 40. Therefore, the platform 60 controls the minimal acceptable radius of the curved rib 40 of the complementary bushing 20.

The minimal and maximal acceptable radii are respectively the minimal inner radius and the maximal outer radius that the curved rib 40 of the bushing 20 can have to be engageable with a corresponding rolled product connector 65 as described herein.

Therefore, the curved rib 40 of an incompatible bushing, either having a greater or smaller diameter, a greater thickness and/or a greater height, cannot be inserted in the recess 67 and thereby prevent proper coupling of the bushing 20 with the rolled product connector 65.

For instance, regarding the height, if the curved rib 40 is too high, i.e. it protrudes too much from the planar wall portion 34 with respect to a depth of the recess 67 of the rolled product connector 65, the pin 70 of the rolled product connector 65 cannot fully engage with the pin-receiving hole 36 of the bushing 20 to reach for instance a coupled configuration as shown in FIG. 11. If the curved rib 40 is too thick, then the curved rib 40 is not insertable in the recess 67 defined between the platform 60 and the outer wall structure 80. Similarly, if the rib radius is either too short or too long with respect to the position of the platform 60 and the outer wall structure 80 considering the position of the pin 70, the curved rib 40 interferes with the platform 60 or the outer wall structure 80 and thereby, prevent or limit coupling between the bushing 20 and the rolled product connector 65.

It is also appreciated that other parts of the bushing 20 can interfere with the rolled product connector 65 and vice-versa.

In the embodiment shown, the inner peripheral wall 82 of the platform 60 can be divided into a lower side wall 64 and an upper side wall 62. In the embodiment shown in FIG. 5, each one of the upper and lower side walls 62, 64 has a curve-shaped profile conforming with a curvature of the curved rib 40 of the complementary bushing 20, i.e. all of them being an arc of a circle characterized by a similar radius. In the embodiment of FIG. 5, the centers of arc of a circle characterizing the upper and lower side walls 62, 64 are offset in a manner such that the protruding platform 60 approximately takes the shape of a football (hereinafter the "football-shaped platform") when observed from a front elevation view. In the embodiment of FIG. 5, a size or surface area of the football-shaped platform 60 corresponds to an intersection area obtained by superimposing a circle concentric with a center of the pin 70 having a radius substantially equal to or slightly smaller than the inner radius "r" of the curved rib 40 of the complementary bushing 20 to define the lower side wall 62 and a circle of substantially the same radius concentric with a center located below the center of the pin 70 (i.e., offset downwardly) to define the upper side wall (see FIGS. 10*a* and 10*b*). Such configuration substantially can prevent or at least limit the workability of a bushing 20 having a curved rib 40 characterized by a smaller radius than the radius of the football-shaped platform 60 of a given support member 54. It is appreciated that the shape of the platform 60 can differ from the football-shaped platform shown in FIG. 5. For example, the platform 60 can include a single elongated strip extending downward in relation to the pin 70.

It is appreciated that, with regard to the radius of the lower side wall 62, it can have substantially the same radius as the inner radius "r" of the curved rib 40 of a complementary one of the bushings 20. In an embodiment, the center of the arc of the circle of the lower side wall 62 can be offset slightly upwardly from the center of the pin 70. In another embodiment, the radius of the lower side wall 62 can be slightly smaller than the inner radius "r" of the curved rib 40 of a complementary one of the bushings 20 with their centers being concentric.

Other non-limitative embodiments of the rolled product connector 65 are described below in reference to FIGS. 6, 7, and 8.

Figure 6A:
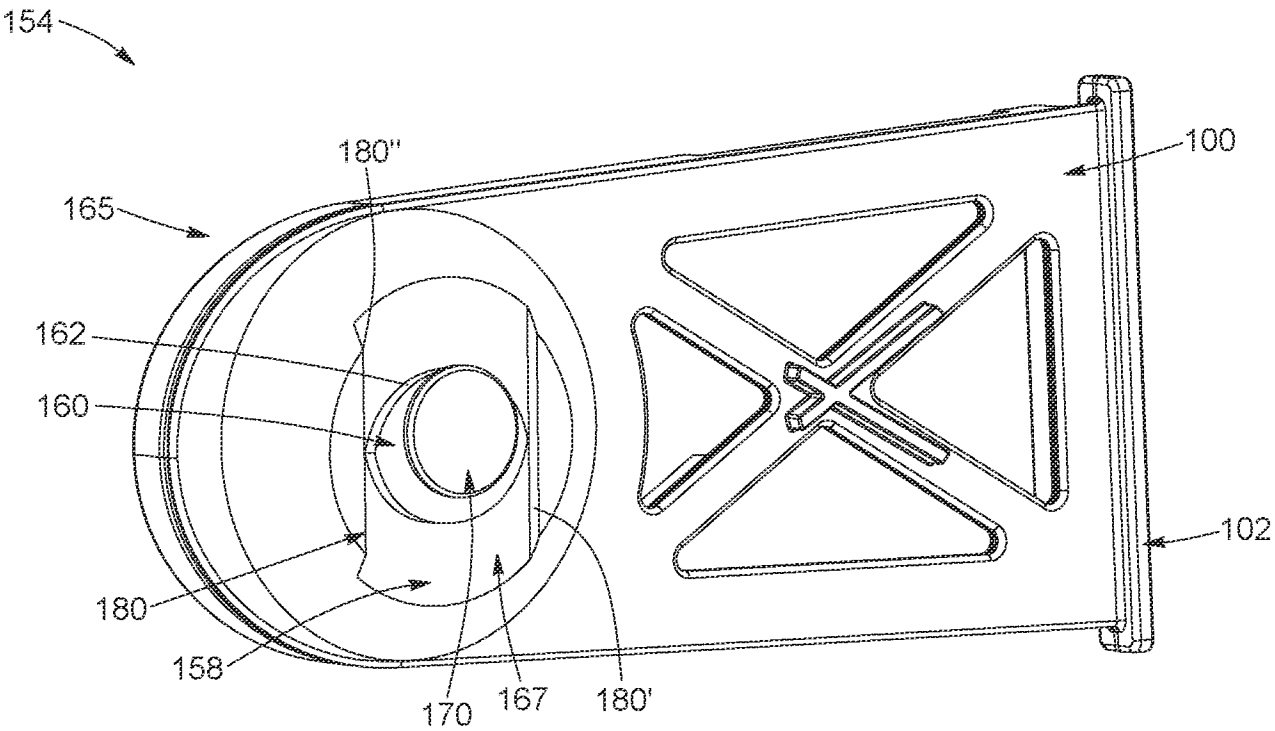
FIG. 6*a* is a front perspective view of the rolled product connector in accordance with another embodiment, wherein the wall structure includes opposite sections of an outer wall structure.
Figure 6B:
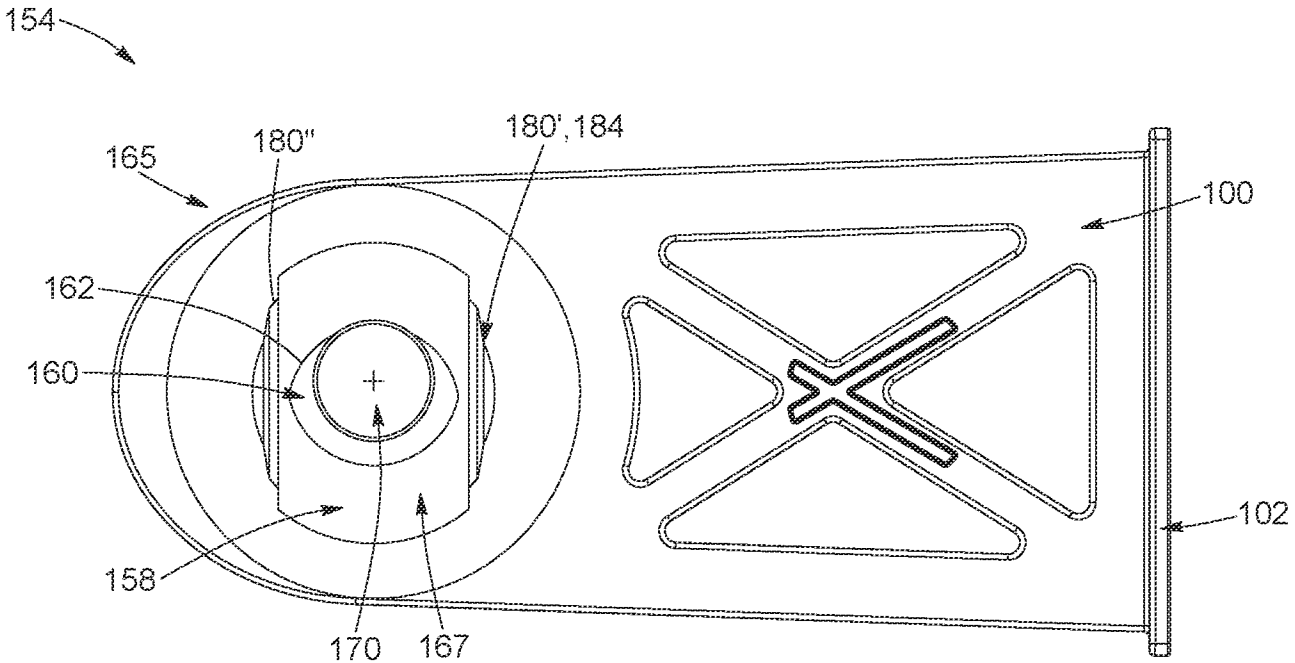
FIG. 6*b* is a front elevation view of the rolled product connector shown in FIG. 6*a;*

Turning to FIGS. 6*a* and 6*b*, there is shown an alternative embodiment of the rolled product connector of the support member 54 wherein the features are numbered with reference numerals in the 100 series which correspond to the reference numerals of the previous embodiment. The rolled product connector 165 is similar to the rolled product connector 65 shown in FIG. 5, except that the outer wall structure 180 surrounds partially the platform 160. In fact, in this non-limitative embodiment, the outer wall structure 180 of the rolled product connector 165 includes two opposite sections 180', 180" extending on each lateral sides of the platform 160. Yet another departure from the embodiment of FIG. 5 is that each section 180', 180" of the outer wall structure 180 has a stepped profile 184 tapering towards the base wall 158 (as better shown in FIG. 6*b*).

In the embodiments wherein the outer wall structure 180 surrounds partially the platform 160, the recess 167 corresponds to a volume above the base wall 158 delimited by the outer wall structure 180 when present and the platform 160.

The recess 167 surrounds the platform 160 and has a width corresponding at least to a distance between the platform 160 and the outer wall structure 180 along a horizontal axis. When the outer wall structure 180 includes two sections 180', 180", the distance is the one between a closest one of the sections 180', 180" and the platform 160.

In embodiments wherein the platform does not surround the pin, such as the one shown in FIG. 8 detailed below, the recess surrounds a combination of the pin and the platform. It surrounds the pin in areas wherein the platform does not protrude outwardly from the pin.

As in other embodiments, the distance between the outer wall structure 180 and the platform 160 and a radius of the platform 160 for the section including the lower side wall 162 delimit the compatible bushings 20 and, more particularly, the rib radii of the curved ribs 40 engageable in the recess 167 in an "insertion" configuration and an "offset" configuration, as will be described in more details below.

In the embodiment wherein the outer wall structure 180 has a stepped profile, as shown in FIGS. 6*a* and 6*b*, the compatible bushings are determined based on a position of the step closer to the platform 160, i.e. adjacent to the base wall 158.

It is appreciated that, in an alternative embodiment (not shown), the outer wall structure 180 of the rolled product connector 165 can include a single section on one lateral side of the platform 160 (e.g., either section 180' or section 180"). One lateral section of the outer wall structure 180 would suffice to discriminate against a curved rib of a bushing having a radius too great by imposing the maximal acceptable radius.

Figure 7:
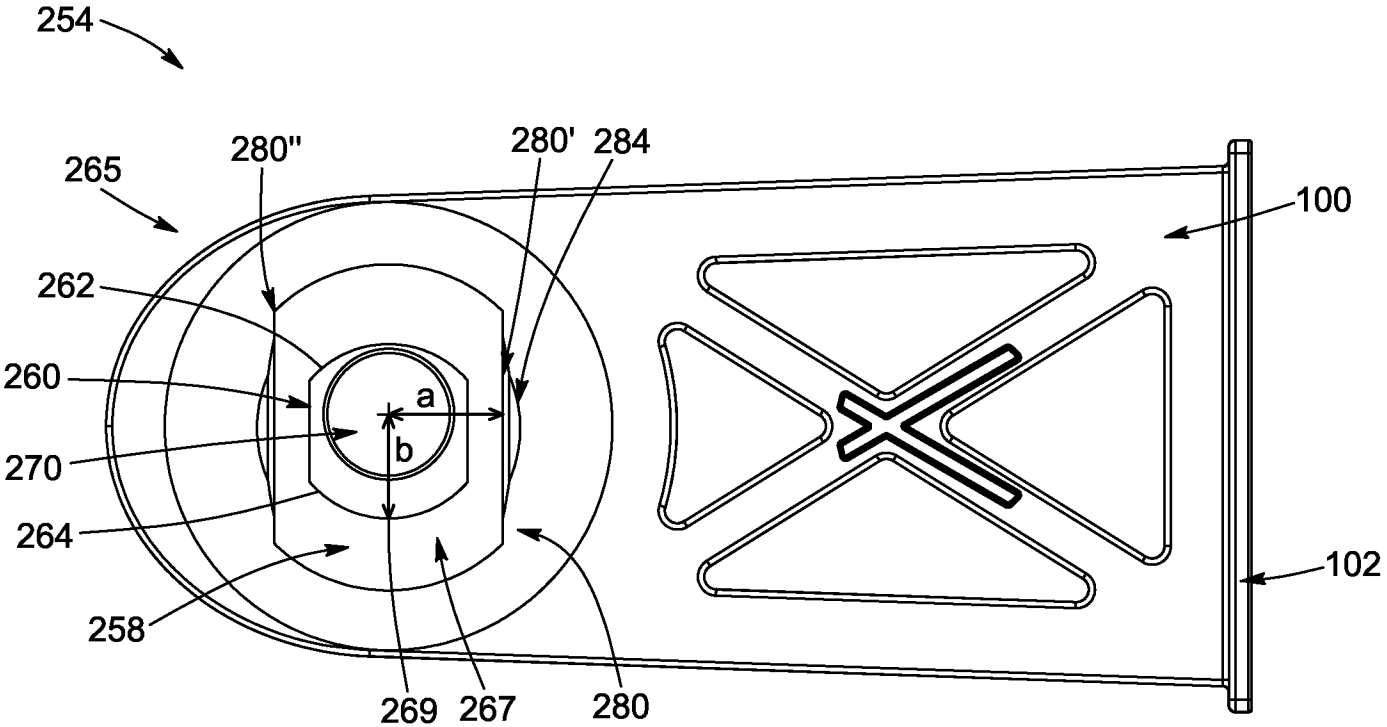
FIG. 7 is a front elevation view of the rolled product connector in accordance with still another embodiment, wherein the platform is laterally truncated.

Referring now to FIG. 7, there is shown another alternative embodiment of the rolled product connector of the support member 54 wherein the features are numbered with reference numerals in the 200 series which correspond to the reference numerals of the previous embodiments. The rolled product connector 265 shown in FIG. 7 is similar to the rolled product connector 165 of FIGS. 6*a* and 6*b*, except that the lateral sides of the platform 260, protruding from the base wall 258, are truncated substantially vertically from the upper side wall 262 to the lower side wall 264. Furthermore, each one the opposite sections 280', 280" of the outer wall structure 280 has a narrow step profile 284, in comparison with the stepped profile 184 shown in FIGS. 6*a* and 6*b*.

In the present embodiment wherein the ends of the platform 260 are truncated, the recess 267 still surrounds the platform 260 with a width corresponding to a distance a closest one of the opposite sections of the outer wall structure 280', 280" and the truncated platform 260 along a horizontal axis and, more particularly, a location of the step closer to the platform 160.

To engage the recess 267 of the rolled product connector 265 as intended herein, the corresponding curved rib 40 of the bushing 20 should have an outer radius "R" smaller than the maximal acceptable radius, and an inner radius "r" greater than the minimal acceptable radius, as explained above. The boundaries of the recess 267, delimitated by the outer wall structure 280 and the inner peripheral wall of the platform 260 (more particularly the lower side wall 262), define the maximal and minimal acceptable radii of the curved rib 40.

In the embodiment shown, a distance between an edge of the nearest section of the wall structure 280', 280" and a center of the pin 270 (depicted as the distance "a") corresponds to the maximal acceptable radius that the outer radius "R" of the curved rib 40 can have to be insertable in the recess 267 without interfering with the outer wall structure 280.

The distance between the nadir 269 of the lower side wall 264 of the platform 260 with respect to the center of the pin 270 (depicted as the distance "b") can determine the minimal acceptable radius for the inner radius "r" of the curved rib 40, i.e. the minimal radius that the inner radius "r" can have to be engageable in the recess without interfering with the platform 260 upon engagement of the bushing 20 with the pin 70 when they are concentric. It should be noted that the principles of the minimal and maximal acceptable radii as exemplified in respect to the recess 267 embodiment shown in FIG. 7 apply to respective recess boundaries and by extension respective platforms and outer wall structures of the other captivity embodiments illustrated herein.

Figure 8:
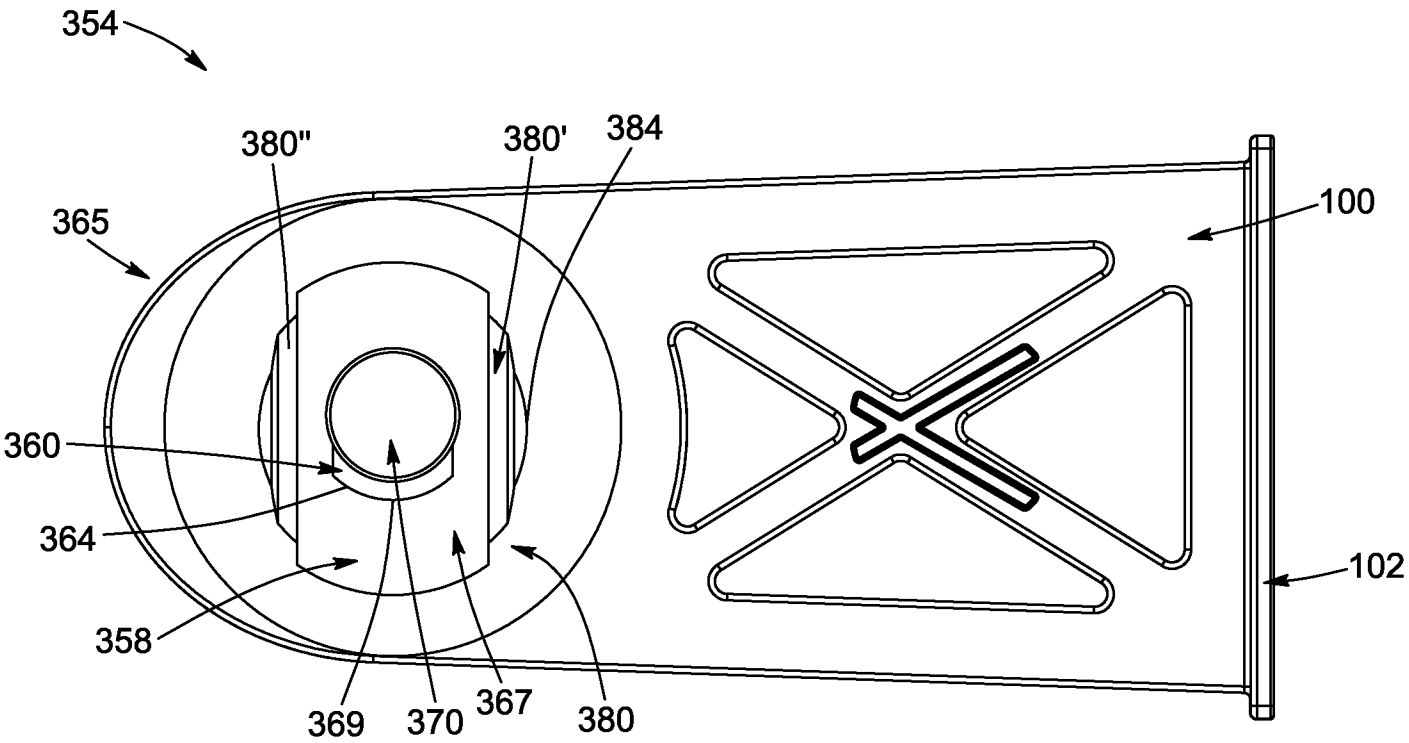
FIG. 8 is a front elevation view of the rolled product connector in accordance with a further embodiment, wherein the platform is further laterally truncated and opposite sections of the outer wall structure have a stepped shape.

Referring to FIG. 8, there is shown another alternative embodiment of the rolled product connector of the support member 54 wherein the features are numbered with reference numerals in the 300 series which correspond to the reference numerals of the previous embodiments. Similarly to the embodiment shown in FIG. 7, the platform 360 of the rolled product connector 354 is truncated laterally, but to a greater extent. The outer wall structure 380 includes opposite sections 380', 380" characterized by a stepped profile 384. The stepped profile 384 is more pronounced and extends further laterally compared to the embodiment of FIG. 7. The platform 360, protruding from the base wall 358, includes the lower side wall 364 having a nadir 369, which is located closer to the pin 370, in comparison to the platform 260 shown in FIG. 7.

In the embodiment shown in FIG. 8, the platform 360 of the rolled product connector 354 does not protrude outwardly by circumscribing the pin 370. It only protrudes in a lower portion. Therefore, the recess 367 corresponds to a volume above the base wall 358 delimited by the outer wall structure 380 when present, the pin 370, and the platform 360. The recess 367 surrounds the platform 360 and the pin 370 and has a width corresponding at least to a distance between the platform 360 and the outer wall structure 380 along a horizontal axis, extending outwardly from a combination of the platform 360 and the pin 370.

Furthermore, in the embodiment of FIG. 8, the platform 360 of the rolled product connector 365 does not include an upper side wall protruding above the pin 370.

Figure 9:
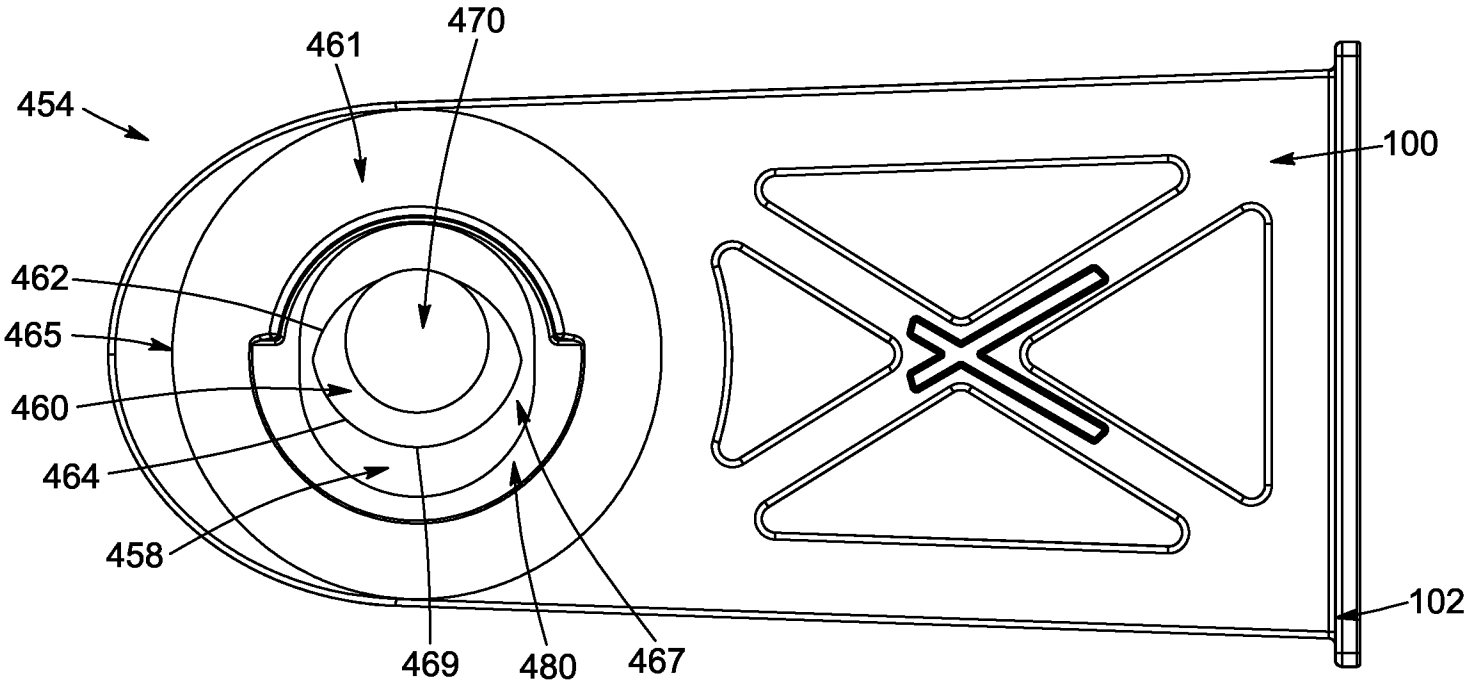
FIG. 9 is a front elevation view of still another embodiment of the rolled product connector, wherein the outer wall structure partially encircles the football-shaped platform.

Referring now to FIG. 9, there is shown an alternative embodiment of the support member wherein several features are numbered with reference numerals in the 400 series which correspond to the reference numerals of the previous embodiments. The support member 454 shown in FIG. 9 is similar to the support members insofar that the support member 454 includes a rolled product connector 465 having a football-shaped platform 460, except that the outer wall structure 480 projects from the base wall 458 to surround the football-shaped platform 460 following an oblong shape. In another departure from previous embodiments, the rolled product connector 465 of the support member 454 further includes a hood 461 that partially (half) encircles the oblong shaped outer wall structure 480. Similar to the embodiment shown in FIGS. 6*a* and 6*b*, the football-shaped platform 460 includes an upper side wall 462 and a lower side wall 464 having a nadir 469. As such, the recess 467 shown in this embodiment is defined similarly to the recess described with respect to FIGS. 6*a* and 6*b*.

Non-limitative embodiments of the rolled product connector 65, 165, 265, 365, 465 have been described. It is appreciated that the shape and the configuration of the rolled product connector 65, 165, 265, 365, 465 can vary from the embodiments shown. For instance and without being limitative, the shape and the size of the pin 70, 170, 270, 370, 470, the platform 60, 160, 260, 360, 460, and the outer wall structure 80, 180, 280, 380, 480 can vary, provided that their relative configuration, size and shape limit the bushings that can be mounted thereto.

Figure 12:
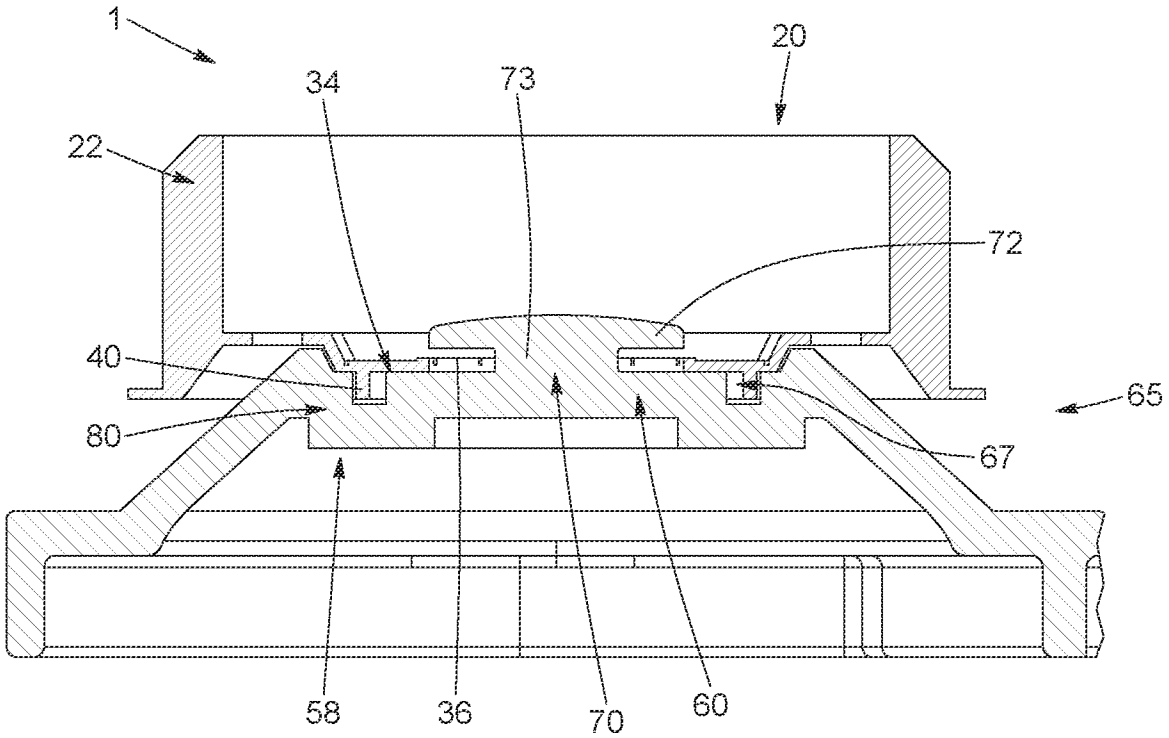
FIG. 12 is a top plan cross-section view of the rolled product connector being engaged with the bushing in accordance with an embodiment.

The following paragraphs describes the interaction between the bushing 20 and the support member 54, 154, 254, 354, 454 with reference to FIGS. 10 to 12. For simplicity, the reference numerals below 100 will be used for the description. However, it is appreciated that the description applies to all the embodiments described herein and variations thereof.

Figure 10A:
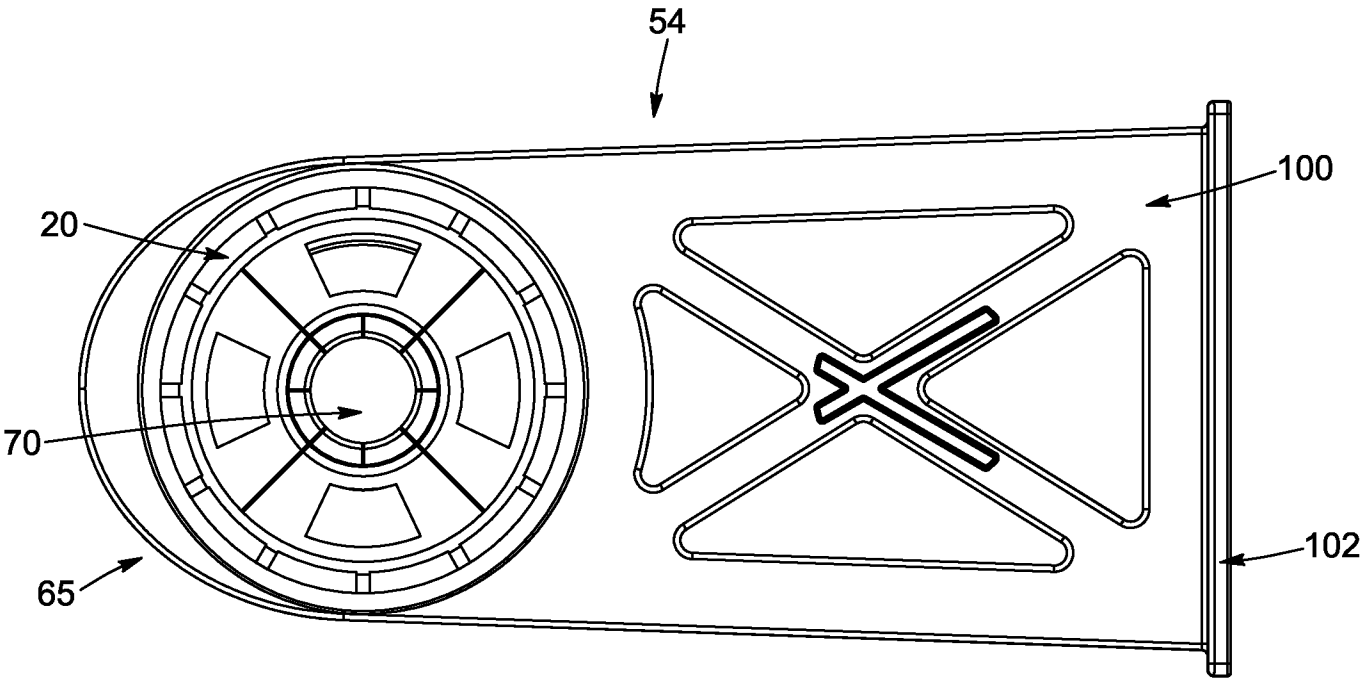
FIG. 10*a* is a front elevation view of the rolled product connector in accordance with another embodiment, showing the rolled product connector being engaged by a bushing in an "insertion" configuration.
Figure 10B:
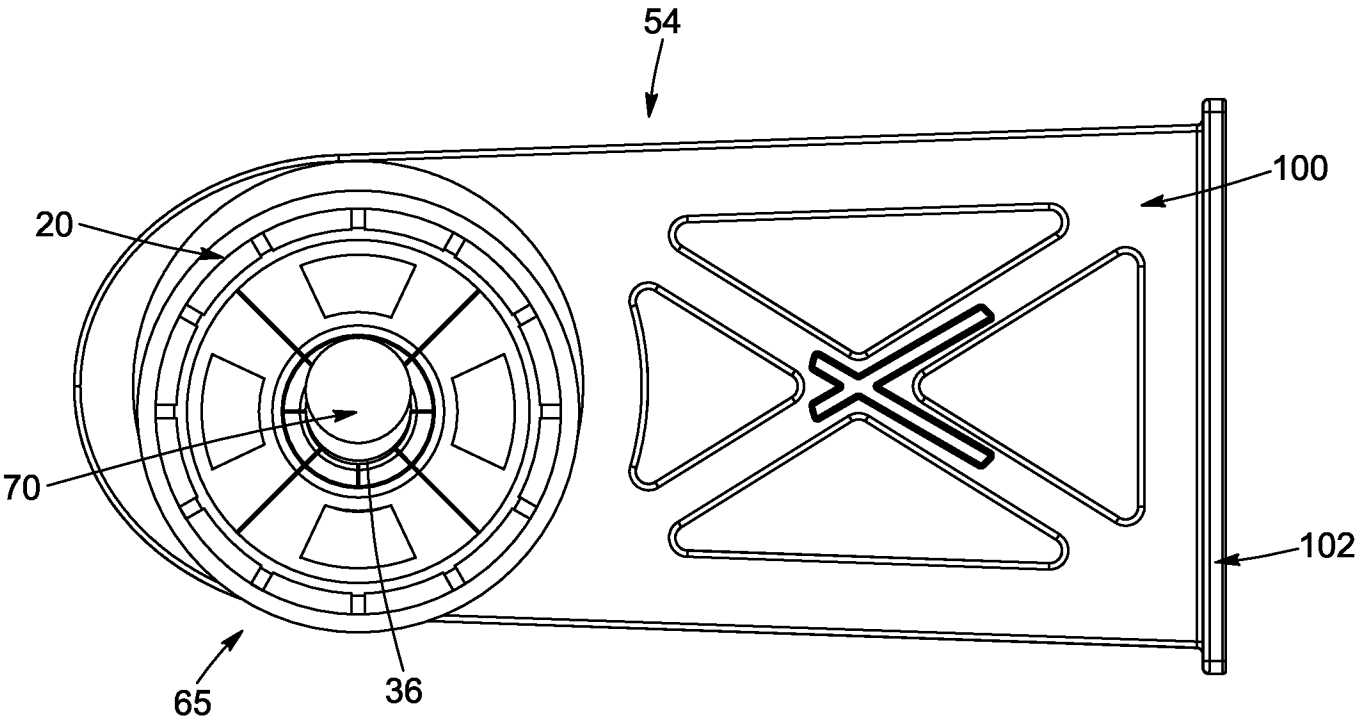
FIG. 10*b* is a front elevation view of the rolled product connector in accordance with the embodiment illustrated in FIG. 10*a*, showing the rolled product connector being engaged by the bushing in an "offset" configuration.

When the rolled product 10 including the proprietary bushing 20 is mounted onto the support member 54 including the rolled product connector 65, the bushing 20 is initially engaged with the rolled product connector 65, as shown in FIG. 10*a*, in a configuration wherein the pin-receiving hole 36 of the bushing 20 is substantially concentric with the pin 70 of the rolled product connector 65 (hereinafter, the "insertion" configuration). Then, as shown in FIG. 10*b*, if a diameter of the pin-receiving hole 36 of the bushing 20 is greater than a diameter of the pin 70 or if the pin 70 includes a head 72 protruding from a stem 73 having a smaller diameter than a diameter of the head 72 (see FIG. 12), the rolled product 10 can slide downwardly, for instance by gravity. The rolled product 10 is thus supported by the rolled product connector 65 and, more particularly, the pin 70 is engaged in the pin-receiving hole 36 of the bushing 20 in a configuration wherein the center of the pin 70 is located above the center of the pin-receiving hole 36, as mentioned above. Therefore, the pin 70 and the pin-receiving hole 36 are offset (hereinafter, the "offset" configuration). In the offset configuration, the roll product 10 is rotatably mounted to the rolled product connector 65 and, more particularly, supported by the pin 70.

FIG. 11 is a schematic illustration of the bushing 20 engaged with the rolled product connector 65 in the offset configuration. The pin 70 of the rolled product connector 65 protrudes from the platform 60 and its center is offset vertically from the center of the platform 60 by a distance "v", as shown by axes "B" and "C" extending across the center of the pin 70 and the center of the platform 60, respectively. The center of the platform 60 is located below the center of the pin 70. Horizontally, the center of the pin 70 and the center of the platform 60 are aligned as shown by axis "A" which extends across their centers. The vertical offset "v" can be smaller or greater depending on the relative size of the head 72 and the stem 73 of the pin 70 and a diameter of the pin-receiving hole 36 of the bushing 20. Reference numeral 90 corresponds to a center of the pin-receiving hole 36 of the bushing 20 in the offset" configuration and in a stationary configuration, i.e. when the rolled product 10 is not engaged in rotation about the rolled product connector 65.

FIG. 12 shows, in more details, the engagement between the rolled product connector 65 and the bushing 20. As mentioned above, the pin 70 of the rolled product connector 65, protruding from the platform 60, is engaged in the pin-receiving hole 36 of the bushing 20 to allow the bushing 20 to rotate once the bushing 20 is in the "offset" configuration. In the non-limitative embodiment shown, the pin 70 has a mushroom shape with the head 72 of a given diameter protruding from an end of the stem 73 of a smaller diameter. The diameter of the head 72 is however smaller than the diameter of the pin-receiving hole 36 of the bushing 20 to allow engagement therebetween. In the embodiment shown, the diameter of the head 72 is barely smaller than the diameter of the pin-receiving hole 36 so that an edge of the pin-receiving hole 36 is almost in register with an outer edge of the head 72 in the "insertion" configuration. Therefore, to insert the pin 70 in the pin-receiving hole in the "insertion" configuration, the bushing 20 is pushed against the rolled product connector 65. If necessary, a plastic material of the planar wall portion 34 may be resilient and slightly bend to allow the head 72 of the pin 70 to pass through the bushing 20.

In the "offset" configuration, the curved rib 40 is inserted in the recess 67 of the rolled product connector 65. Since FIG. 12 is a top plan cross-section view, the curved rib 40 is shown inserted in the recess 67.

Thus, for the rolled product 10 being rotatable about the rolled product connector 65 when engaged therewith, the inner radius "r" of the curved rib 40 of the bushing 20 is selected not to interfere with the inner peripheral wall 82 of the platform 60, including the lower side wall 62 and the upper side wall 64. In an embodiment, the inner radius "r" of the curved rib 40 of the bushing 20 is greater than the distance "b" (FIG. 7) between the center of the pin 70 and the nadir 69 of the inner side wall 62. Otherwise, interference between the curved rib 40 and the platform 60 will occur upon engagement of the bushing 20 with the rolled product connector 65. Furthermore, the outer radius "R" of the curved rib 40 of the bushing 20 is smaller than a distance "a" (FIG. 7) between the center of the pin 70 and the outer wall structure 80. Otherwise, interference between the curved rib 40 and the outer wall structure 80 will occur upon rotation of the bushing 20 about the pin 70 of the rolled product connector 65.

Furthermore, upon engagement of the bushing 20 with the rolled product connector 65 and rotation of the bushing 20 about the rolled product connector 65, the curved rib 40 should not interfere with any other component of the rolled product connector 65. Thus, the bushing 20 should be freely rotatable about the pin 70 of the rolled product connector 65, i.e. the curved rib 40 of the bushing 20 should not interfere with the components of the rolled product connector 65, such as the outer wall structure 70 and the platform 60 during rotation. For instance and without being limitative, a distance between an apex of the upper side wall 64 of the platform 60 and a center of the pin 70 should be smaller than the inner radius "r" of the curved rib 40 of the bushing 20 to prevent interference upon engagement of the bushing 20 with the rolled product connector 65.

As mentioned above, the curved rib 40 includes at least one opening 41 which length is greater than a diameter of the pin 70 and, more particularly, at least a diameter of the head 72 of the pin 70. Upon rotation of the rolled product 10 onto the pin 70, the bushing 20 having an incompatible shape and/or configuration respective to the rolled product connector 65 would not engage the rolled product connector 65 as it is intended to.

It is understood that a curved rib 40 embodied as a closed ring (not shown) would be compatible with a dispenser rolled product connector 65 disclosed herein provided the appropriate dimensions. However, an only partially circled rib presenting one or more openings 41 defined between adjacent rib segment extremities as shown in FIGS. 2*a* and 3, can offer advantages compared to a rib that would fully encircle the pin-receiving hole 36. Indeed, a partially circled rib can render an associated rolled product 10 less compatible with unwanted dispenser configurations. For example, if a user were to attempt to mount a rolled product 10 equipped with a bushing comprising a rib fully encircling the pin-receiving hole 36 onto the rolled product connector 65, without fully engaging an incompatible pin of an improper dispenser, the fully circled rib could ironically allow the bushing to hang on the improper dispenser by preventing the bushing from slipping off the incompatible pin with the fully circled rib acting as a lateral retention barrier. With any of the embodiments shown in FIGS. 2*a* to 3, the opening(s) 41 offers an escape configuration for a bushing 20*a*, 20*b* to disengage the incompatible pin.

The captivity features of the support member 54 and its rolled product connector 65, including the base wall 58, the pin 70, the outer wall structure 80, the platform 60 or any combination thereof can be manufactured from a single mold, whether it concerns injection molding, compression molding or any plastic molding method commonly used. For instance, the embodiments of the support member 54 shown in FIGS. 5 and 9 may not be made of a single mold/piece. In some embodiments, the support member 54 can be made of two or more components assembled together.

A rolled product, including the bushing 20 having a curved rib as disclosed above, may not properly fit all rolled product dispensers. More particularly, the bushing 20 is designed for specific rolled product dispensers. To some extent, this constraint ensures that a rolled product equipped with a bushing as disclosed above generally cannot be mounted properly on a different dispenser provided with another type of rolled product connector. This system can result in a form of quality control as there is a reduction of maintenance and repair costs for the dispensers. Occurrences of damage caused to a dispenser through installation of an incompatible roll product in the dispenser can be reduced since the dispenser can only function properly when a compatible rolled product having an appropriate bushing is mounted therein.

The benefits of the roll dispenser 50 and associated bushing 20 disclosed herein may not limited to captivity, as this assembly 1 shows other practical advantages. For example, it was revealed during testing that the combination of the roll dispenser 50 captivity system embodied in FIGS. 6*a* to 9 with their associated bushings 20 can advantageously offer a lower pull force compared to other prior art dispensers, meaning that a user may on average use less force to pull the same amount of rolled product from a roll thereof. It was also found during testing of the embodiments that the operation of a roll can be smoother compared to existing rolled product captivity assemblies in the sense that a user will consistently pull a single sheet for a same amount of pull force.

Moreover, it will be appreciated that positional descriptions such as "above", "below", "forward", "rearward", "left", "right" and the like should, unless otherwise indicated, be taken in the context of the figures only and should not be considered limiting. Moreover, the figures are meant to be illustrative of certain characteristics and are not necessarily to scale.

In the description, an embodiment is an example or implementation. The various appearances of "one embodiment", "an embodiment" or "some embodiments" do not necessarily all refer to the same embodiments. Although various features may be described in the context of a single embodiment, the features may also be provided separately or in any suitable combination. Conversely, although the invention may be described herein in the context of separate embodiments for clarity, it may also be implemented in a single embodiment. Reference in the specification to "some embodiments", "an embodiment", "one embodiment" or "other embodiments" means that a particular feature, structure, or characteristic described in connection with the embodiments is included in at least some embodiments, but not necessarily all embodiments.

It is to be understood that the phraseology and terminology employed herein is not to be construed as limiting and are for descriptive purpose only. The principles and uses of the teachings of the present disclosure may be better understood with reference to the accompanying description, figures and examples. It is to be understood that the details set forth herein do not construe a limitation to an application of the disclosure.

Furthermore, it is to be understood that the disclosure can be carried out or practiced in various ways and that the disclosure can be implemented in embodiments other than the ones outlined in the description above. It is to be understood that the terms "including", "comprising", and grammatical variants thereof do not preclude the addition of one or more components, features, steps, or integers or groups thereof and that the terms are to be construed as specifying components, features, steps or integers. If the specification or claims refer to "an additional" element, that does not preclude there being more than one of the additional element. It is to be understood that where the claims or specification refer to "a" or "an" element, such reference should not be construed that there is only one of that element. It is to be understood that where the specification states that a component, feature, structure, or characteristic "may", "might", "can" or "could" be included, that particular component, feature, structure, or characteristic is not required to be included.

Several alternative embodiments and examples have been described and illustrated herein. The embodiments of the invention described herein are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind.

We claim:

1. A bushing for a rolled product having a hollow center portion, comprising:

a cylindrical body sized to be press-fitted into an extremity of the hollow center portion of the rolled product; and an end wall fixed to said cylindrical body for closing at least partially said extremity of the hollow center portion of the rolled product, said end wall having a central pin-receiving hole extending therethrough, an outer surface, and a curved rib projecting outwardly from the outer surface and encircling partially the central pin-receiving hole.

2. The bushing according to claim 1, wherein the curved rib forms a C-shape.

3. The bushing according to claim 1, wherein the curved rib comprises a single rib segment.

4. The bushing according to claim 1, wherein the curved rib comprises a plurality of spaced-apart rib segments equally distributed around the central pin-receiving hole.

5. The bushing according to claim 1, wherein the end wall comprises a centrally located outwardly protruding part comprising a planar wall portion encircling the pin-receiving hole, the curved rib protruding outwardly from the planar wall portion.

6. The bushing according to claim 1, wherein the curved rib has at least two adjacent ends with an opening defined inbetween.

7. A rolled product, comprising:

a roll of web material defining a hollow center portion, with two opposite extremities; and a bushing comprising:

a cylindrical body press-fitted into one of the extremities of the hollow center portion of the roll of web material; and an end wall fixed to the cylindrical body for closing at least partially the extremity of the hollow center portion of the roll of web material, the end wall having a central pin-receiving hole extending therethrough, an outer surface, and a curved rib projecting outwardly from the outer surface and encircling partially the central pin-receiving hole.

8. The rolled product according to claim 7, wherein the curved rib forms a C-shape.

9. The bushing according to claim 7, wherein the curved rib comprises a single rib segment having at least two adjacent ends with an opening defined inbetween.

10. The bushing according to claim 7, wherein the curved rib comprises a plurality of spaced-apart rib segments equally distributed around the central pin-receiving hole.

11. A combination of a rolled product dispenser with a rolled product as defined in claim 7, the dispenser comprising: a pair of support members for supporting the rolled product inbetween, at least one of said support members comprising a rolled product connector comprising a base wall, an outer wall structure, a platform, and a pin protruding from the platform, wherein the outer wall structure and the platform protrude from the base wall and being spaced-apart from one another to define a recess inbetween, and a pin protruding from the platform, the outer wall structure being located outwardly with respect to the platform, the platform having a lower side wall extending below the pin, the pin being engageable in the central pin-receiving hole of the bushing of the rolled product with the curved rib of the bushing being inserted in the recess and to allow the rolled product to rotate once the bushing is engaged with the pin.

12. The combination of claim 11, wherein the lower side wall of the platform defines an arc of a circle with a center thereof being concentric a center of the pin; and wherein the curved rib has a radius greater than a radius of the arc of the circle of the lower side wall.

13. The combination of claim 11, wherein the outer wall structure surrounds at least partially the platform and the bushing is freely rotatable about the pin with the curved rib remaining fully inserted in the recess.

14. The combination of claim 11, wherein the outer wall structure includes at least two sections, each one extending on a respective lateral side of the pin.

15. The combination of claim 11, wherein the curved rib has at least two adjacent ends with an opening defined inbetween and a length of the opening is longer than a diameter of the pin.

16. The combination of claim 11, wherein the curved rib has an outer radius and the outer radius is smaller than a distance between a center of the pin and the outer wall structure and the inner radius is greater than a distance between a center of the pin and a nadir of the lower side wall of the platform.

17. A rolled product dispenser, comprising: a pair of support members for supporting a rolled product inbetween, at least one of said support members comprising a rolled product connector comprising a base wall, an outer wall structure, a platform, and a pin protruding from the platform, wherein the outer wall structure and the platform protrude from the base wall and being spaced-apart from one another to define a recess inbetween, the outer wall structure being located outwardly with respect to the platform, the platform having a lower side wall extending below the pin, the pin being engageable in a pin-receiving hole of a bushing of the rolled product and to allow the rolled product to rotate once the bushing is engaged with the pin.

18. The rolled product dispenser of claim 17, wherein the lower side wall of the platform defines an arc of a circle with a center concentric with a center of the pin.

19. The rolled product dispenser of claim 17, wherein the outer wall structure at least partially surrounds the platform.

20. The rolled product dispenser of claim 17, wherein the outer wall structure includes at least two sections, each one extending on a respective lateral side of the pin.

* * * * *